US009694937B2

(12) United States Patent
Nakayama et al.

(10) Patent No.: US 9,694,937 B2
(45) Date of Patent: Jul. 4, 2017

(54) COMPONENT CARRYING TRAY

(71) Applicant: CANON KABUSHIKI KAISHA, Tokyo (JP)

(72) Inventors: Shugo Nakayama, Kawasaki (JP); Takashi Arai, Tsu (JP); Mikio Nakasugi, Tama (JP); Fumikazu Kobayashi, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 49 days.

(21) Appl. No.: 14/224,465

(22) Filed: Mar. 25, 2014

(65) Prior Publication Data

US 2014/0291192 A1 Oct. 2, 2014

(30) Foreign Application Priority Data

Mar. 27, 2013 (JP) ..... 2013-066174

(51) Int. Cl.
*B65D 21/02* (2006.01)
*B65D 85/02* (2006.01)
(Continued)

(52) U.S. Cl.
CPC ..... *B65D 21/02* (2013.01); *B65D 21/0233* (2013.01); *B65D 25/10* (2013.01);
(Continued)

(58) Field of Classification Search
CPC ..... B65D 21/02; B65D 25/106; B65D 25/10; B65D 85/04; B65D 85/02; B65D 85/06;
(Continued)

(56) References Cited

U.S. PATENT DOCUMENTS 2,788,892 A * 4/1957 Dales ..... B65D 85/672 206/395
2,893,405 A * 7/1959 Castelli ..... A61C 15/043 132/321

(Continued)

FOREIGN PATENT DOCUMENTS

CN 1145610 A 3/1997
CN 1189434 A 8/1998

(Continued)

OTHER PUBLICATIONS

Office Action dated Oct. 10, 2015, in corresponding Chinese Patent Application No. 201410117610.X.

*Primary Examiner* — Jeffrey Allen
*Assistant Examiner* — Jennifer Castriotta
(74) *Attorney, Agent, or Firm* — Fitzpatrick, Cella, Harper & Scinto

(57) ABSTRACT

A component carrying tray includes a bottom plate on which a component is stacked, and a projection. The projection has a main body and a regulator. The main body is hollow and has a tapering shape. The regulator is formed in the main body and extends in a direction perpendicular to the carrying surface and contacts a side surface of the component to regulate the component carried on the carrying surface. The bottom plate has a through hole so that when the component carrying tray is stacked on an additional component carrying tray, a projection of the additional component carrying tray comes into the hollow part of the main body. An opening is formed in the projection and configured to avoid, when the component carrying tray is stacked on an additional component carrying tray, interference between the projection and a regulator of the additional component carrying tray.

10 Claims, 19 Drawing Sheets

(51) Int. Cl.

| | |
|---|---|
| ***B65D 25/10*** | (2006.01) |
| *B65D 85/676* | (2006.01) |
| *B65D 85/06* | (2006.01) |
| *B65D 85/04* | (2006.01) |
| *B65D 85/672* | (2006.01) |

(52) U.S. Cl.
CPC ..... *B65D 25/106* (2013.01); *B65D 85/02* (2013.01); *B65D 85/04* (2013.01); *B65D 85/06* (2013.01); *B65D 85/672* (2013.01); *B65D 85/676* (2013.01)

(58) Field of Classification Search
CPC B65D 85/672; B65D 85/676; B65D 21/0233; B65D 21/023; B65D 21/0209
USPC ..... 220/562, 509; 206/303, 304.2, 689, 408, 206/509, 519, 506
See application file for complete search history.

(56) References Cited

U.S. PATENT DOCUMENTS

| | | | | | |
|---|---|---|---|---|---|
| 3,229,811 | A * | 1/1966 | Studwell | G11B 23/027 | 206/303 |
| 3,280,987 | A * | 10/1966 | Steinbock | A47F 7/17 | 206/303 |
| 4,623,063 | A * | 11/1986 | Balkin | B65D 85/04 | 206/303 |
| 4,664,260 | A * | 5/1987 | Stokes | 206/386 | |
| 4,911,295 | A * | 3/1990 | Venegoni | 206/372 | |
| 4,957,206 | A | 9/1990 | Banko et al. | | |
| 5,040,681 | A * | 8/1991 | Grusin | 206/503 | |
| 5,322,162 | A * | 6/1994 | Melk | G11B 33/045 | 206/308.1 |
| 5,465,843 | A * | 11/1995 | Koefelda | 206/507 | |
| 5,490,595 | A * | 2/1996 | Sakai | B65D 21/023 | 206/397 |
| 5,660,279 | A * | 8/1997 | Apps | B65D 1/243 | 206/503 |
| 5,669,498 | A * | 9/1997 | Fierek et al. | 206/373 | |
| 5,704,482 | A | 1/1998 | Apps et al. | | |
| 5,934,471 | A | 8/1999 | Jun | | |
| 6,059,109 | A * | 5/2000 | Stein | 206/373 | |
| 6,296,118 | B1 * | 10/2001 | Speck | B65D 21/043 | 206/408 |
| 7,017,746 | B2 * | 3/2006 | Apps | 206/509 | |
| 7,380,665 | B2 * | 6/2008 | Ohms | 206/509 | |
| 7,721,882 | B2 * | 5/2010 | Lau | G11B 33/0427 | 206/308 |
| 7,721,883 | B2 * | 5/2010 | Lau | G11B 33/0427 | 206/308.1 |
| 8,146,746 | B2 * | 4/2012 | Apps | 206/509 | |
| 8,186,534 | B2 * | 5/2012 | Apps | 220/515 | |
| 8,292,117 | B2 * | 10/2012 | Guibert et al. | 220/571 | |
| 2004/0188456 | A1 * | 9/2004 | Arai et al. | 221/263 | |
| 2005/0230281 | A1 * | 10/2005 | Hassell et al. | 206/509 | |
| 2007/0017827 | A1 * | 1/2007 | Urquhart et al. | 206/162 | |
| 2007/0215517 | A1 * | 9/2007 | Holler | 206/725 | |
| 2008/0121563 | A1 * | 5/2008 | Polvere et al. | 206/763 | |
| 2008/0128313 | A1 * | 6/2008 | Anderson et al. | 206/565 | |
| 2009/0223854 | A1 * | 9/2009 | Apps | 206/509 | |
| 2010/0170816 | A1 * | 7/2010 | Burgess | B65D 85/04 | 206/348 |
| 2010/0307949 | A1 * | 12/2010 | Apps | 206/509 | |
| 2011/0284411 | A1 * | 11/2011 | Delbrouck et al. | 206/427 | |
| 2012/0321431 | A1 * | 12/2012 | Riedesel et al. | 414/802 | |

FOREIGN PATENT DOCUMENTS

| | | | |
|---|---|---|---|
| CN | 101628643 | A | 1/2010 |
| CN | 102700797 | A | 10/2012 |
| GB | 2252293 | A | 8/1992 |
| JP | S60-021442 | U | 2/1985 |
| JP | S63-082787 | U | 5/1988 |
| JP | H01-167121 | A | 6/1989 |
| JP | H06-122486 | A | 5/1994 |
| JP | H09-511474 | A | 11/1997 |
| JP | 2001-048178 | A | 2/2001 |
| JP | 2009-116079 | A | 5/2009 |
| JP | 2011-140339 | A | 7/2011 |

* cited by examiner

COMPONENT CARRYING TRAY

BACKGROUND OF THE INVENTION

Field of the Invention

The present invention relates to a component carrying tray which carries a plurality of stacked components.

Description of the Related Art

Recently, an automatic assembling apparatus which performs an assembly operation by a robot has been required replacing manual assembly operations. In the manual assembly operation, a human cell production system is introduced so that each operator assembles multiple components. In order to replace the human cell with a robot cell, the automatic assembling apparatus in which an assembling robot can grasp and assemble various components has been required.

In general, a tray is usually used to supply components to the automatic assembling apparatus. A conventional automatic assembling apparatus mainly supplies a small number of components to one assembling robot and performs assembly at high speed. Therefore, a tray on which components are flatly placed as described in Japanese Patent Application Laid-open No. 2011-140339 has been used as the tray which supplies the components to the automatic assembling apparatus. When this tray is used, the flatly placed components can be precisely positioned at regular positions so that the assembling robot can acquire the components. Moreover, a plurality of trays which have not yet contained any components can be densely carried. Thus, conveyance costs of the trays can be reduced.

However, when the tray on which the components are flatly placed as in Japanese Patent Application Laid-open No. 2011-140339 is used, it is difficult to efficiently supply the components within a movable range of the assembling robot in order to supply a large number of components to one assembling robot. That is, a function of densely supplying the components within the limited robot movable range has been further required for a component carrying tray of the robot cell.

Accordingly, in order to densely supply the components, it is possible to carry a plurality of components stacked on the tray and supply the components to the robot cell. For example, when components are circularly cylindrical, it is possible to supply the robot cell with a plurality of components stacked on a circularly columnar component carrying tray. As a result, a plurality of components can be positioned. However, it is difficult to densely carry the component carrying trays containing no components. On the other hand, when the component carrying tray is formed into a truncated cone shape to ensure the function of stacking the component carrying trays, it is difficult to precisely position the components carried on the component carrying trays at regular positions.

SUMMARY OF THE INVENTION

The present invention provides a component carrying tray having both a function of uniformly positioning a plurality of stacked components and a function of densely carrying the component carrying trays carrying no components.

A component carrying tray of the present invention comprises a bottom plate having a carrying surface on which a component is stacked, and a projection formed to project from the carrying surface. The projection includes main body that is hollow and has a tapering shape. The projection also includes a regulator which is formed on the main body and which extends in a direction perpendicular to the carrying surface and which contacts a side surface of the component carried on the carrying surface to regulate the components carried on the carrying surface. The bottom plate has a through-hole at a position corresponding to a hollow part of the main body so that when the component carrying tray is stacked on an additional component carrying tray, a projection of the additional component carrying tray comes into the hollow part of the main body. The projection has an opening is formed in the projection that is configured to avoid, when the component carrying tray is on the additional component carrying tray, interference between the projection and a regulator of the additional component carrying tray.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

First Embodiment

Figure 1:
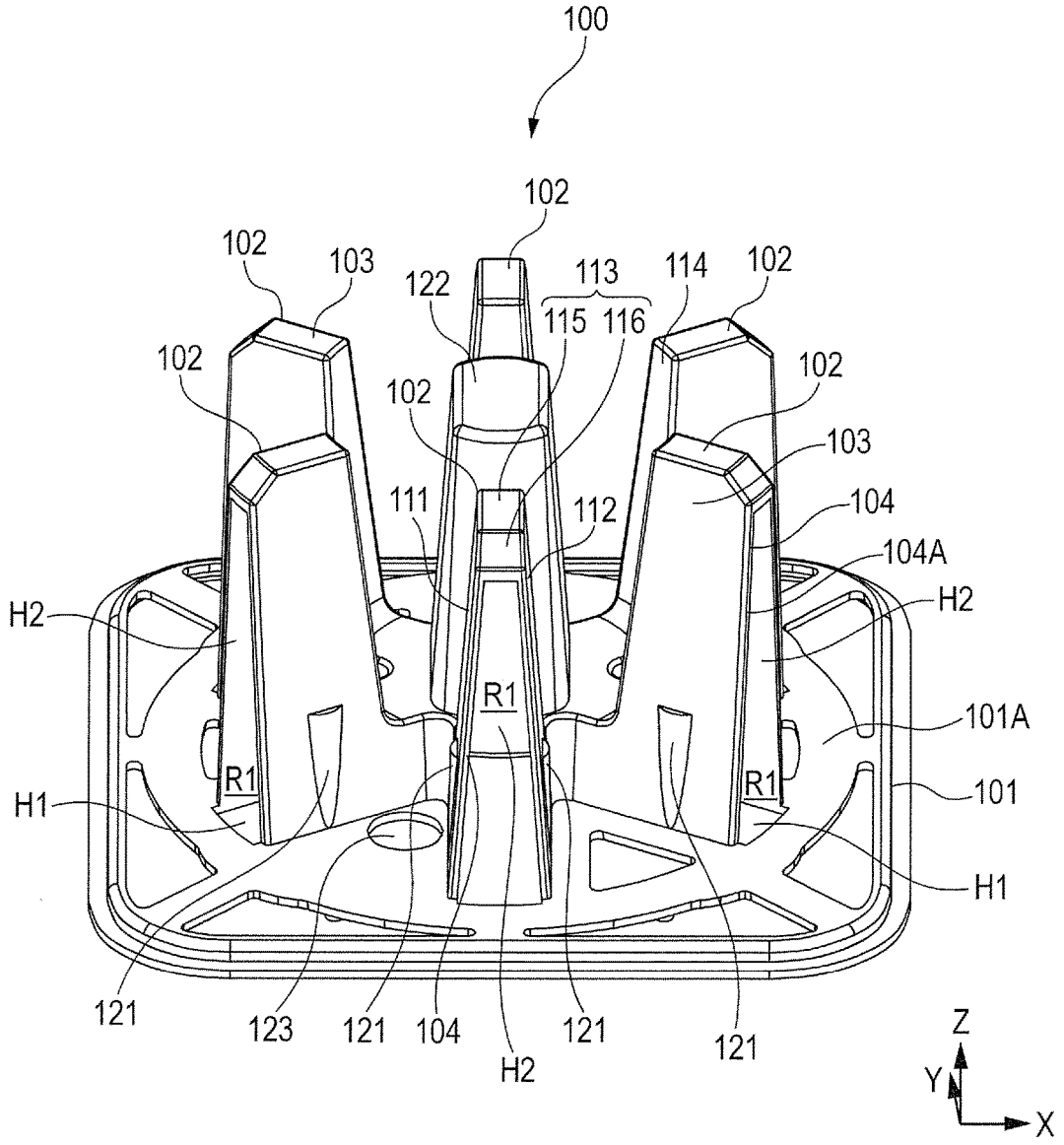
FIG. 1 is a perspective view showing a component carrying tray according to a first embodiment.
Figure 2:
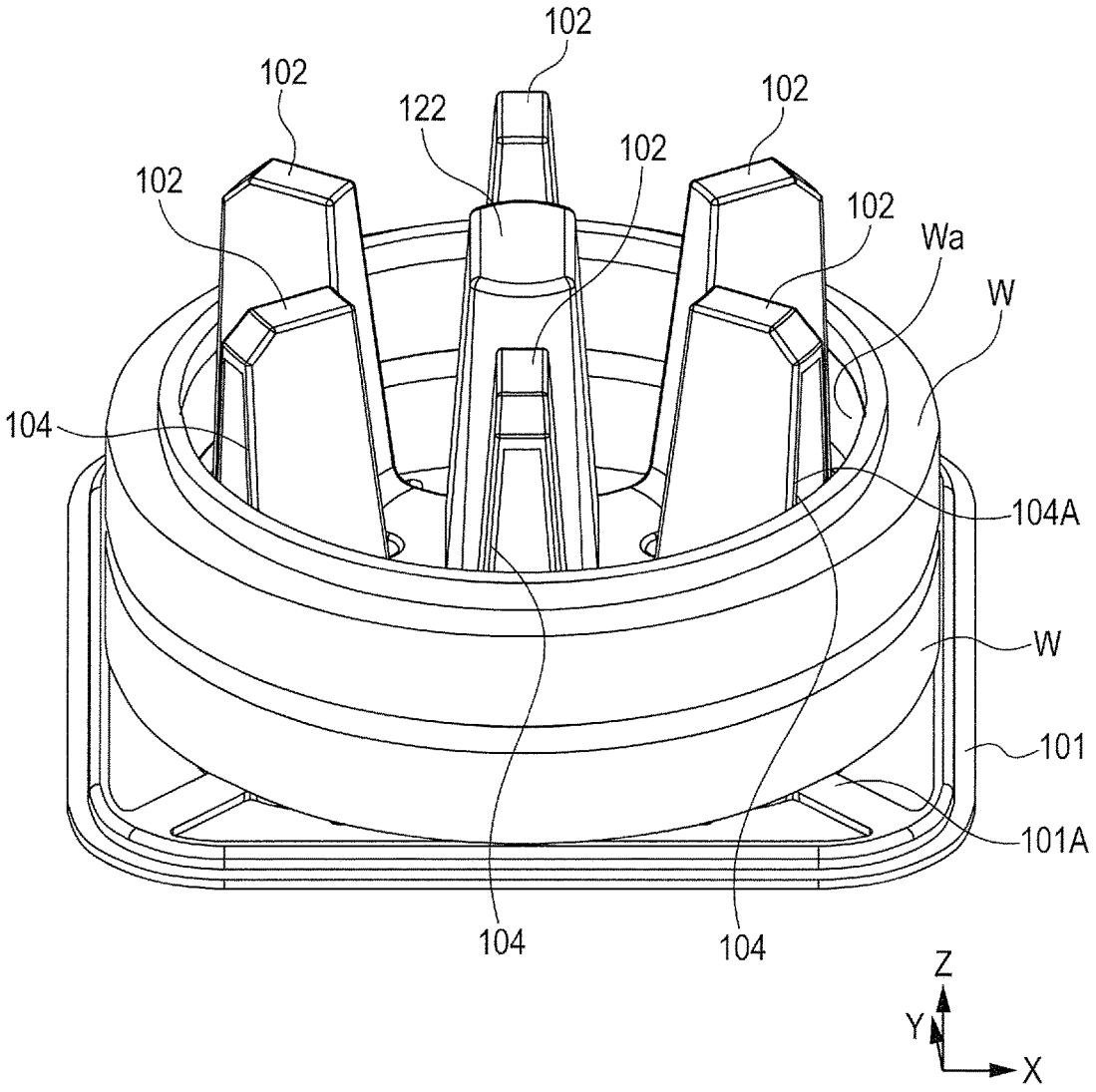
FIG. 2 is a perspective view showing how a plurality of components are carried on the component carrying tray in FIG. 1.
Figure 3:
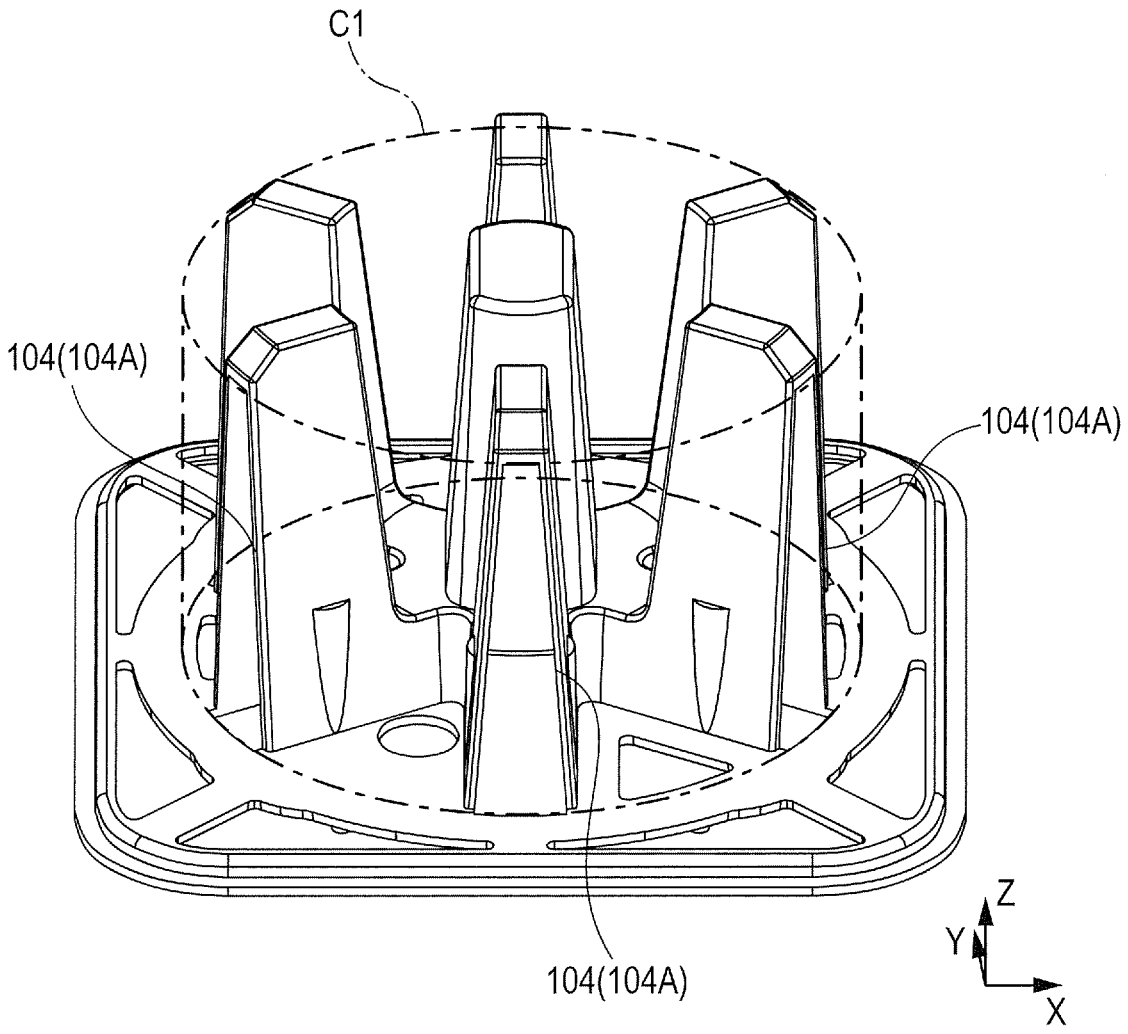
FIG. 3 is a perspective view showing the component carrying tray in which an imaginary cylinder surface along the inside surfaces of a plurality of stacked components is shown.

FIG. 1 is a perspective view showing a component carrying tray according to a first embodiment of the present invention. FIG. 2 is a perspective view showing how a plurality of components is carried on the component carrying tray in FIG. 1. FIG. 3 is a perspective view showing the component carrying tray in which an imaginary cylinder surface along the inside surfaces of a plurality of stacked components is shown.

A component carrying tray 100 comprises a bottom plate 101 having a carrying surface 101A on which a plurality of components W are stacked, and projections 102 formed to project from the carrying surface 101A of the bottom plate 101. The projection 102 has a main body 103, and a regulator 104 which is formed on the main body 103 and which regulates the components W.

The component carrying tray 100 has at least one projection 102 and preferably more than one regulator 104. That is, one projection may have a plurality of regulators when the component carrying tray 100 has one projection, whereas each projection may have one or more regulator 104 when the component carrying tray 100 has a plurality of projections. In the present first embodiment, a plurality of (six in FIG. 1) projections 102 are provided, and each projection 102 has one regulator 104. The plurality of projections 102 are spaced out from one another along the components W carried on the carrying surface 101A. Although six projections 102 are provided in the case described according to the present first embodiment, two or more projections 102 may be provided, and it is particularly preferable to provide three or more projections 102.

The main body 103 is formed into a hollow tapering shape. The regulator 104 is formed to extend in a direction perpendicular to the carrying surface 101A of the bottom plate 101. That is, the regulator 104 is formed to extend in an arrow Z direction intersecting at right angles with an arrow X direction and an arrow Y direction which extend along the carrying surface 101A and which intersect at right angles with each other. The regulator 104 contacts side surfaces Wa of the components W carried on the carrying surface 101A to regulate the position of the components W carried on the carrying surface. According to the present first embodiment, the regulator 104 is formed to extend from a base end (lower end) to a tip end (upper end) of the main body 103 integrally with the main body 103.

According to the present first embodiment, the regulator 104 has a regulating surface 104A, and the regulating surface 104A is perpendicular to the carrying surface 101A. The regulating surface 104A of the regulator 104 comes into surface contact with the side surfaces Wa of the components W.

Here, the components W are formed into a cylindrical shape (specifically, a circularly cylindrical shape). The regulator 104 is positioned on the main body 103 and shaped so that the regulating surface 104A comes into surface contact with the inside surfaces Wa of the components W. In other words, the regulating surface 104A of the regulator 104 is formed into a shape along the inside surfaces Wa of the components W. That is, as shown in FIG. 3, the regulating surface 104A of each regulator 104 is formed into a shape along an imaginary cylinder surface C1 so that the regulating surface 104A comes into surface contact with the imaginary cylinder surface C1 along the inside surfaces Wa of a plurality of stacked components W.

Thus, a plurality of components W stacked on the carrying surface 101A are regulated by contacting the regulator 104, and are precisely positioned at the same position in the arrow X direction and the arrow Y direction. In particular, a plurality of components W stacked on the carrying surface 101A are regulated by surface contact with the regulating surface 104A, and are therefore precisely positioned.

A through-hole H1 is formed in the bottom plate 101 at a position corresponding to a hollow part (cavity part) R1 of the main body 103 so that a projection of an additional component carrying tray comes into the through-hole H1.

Figure 4:
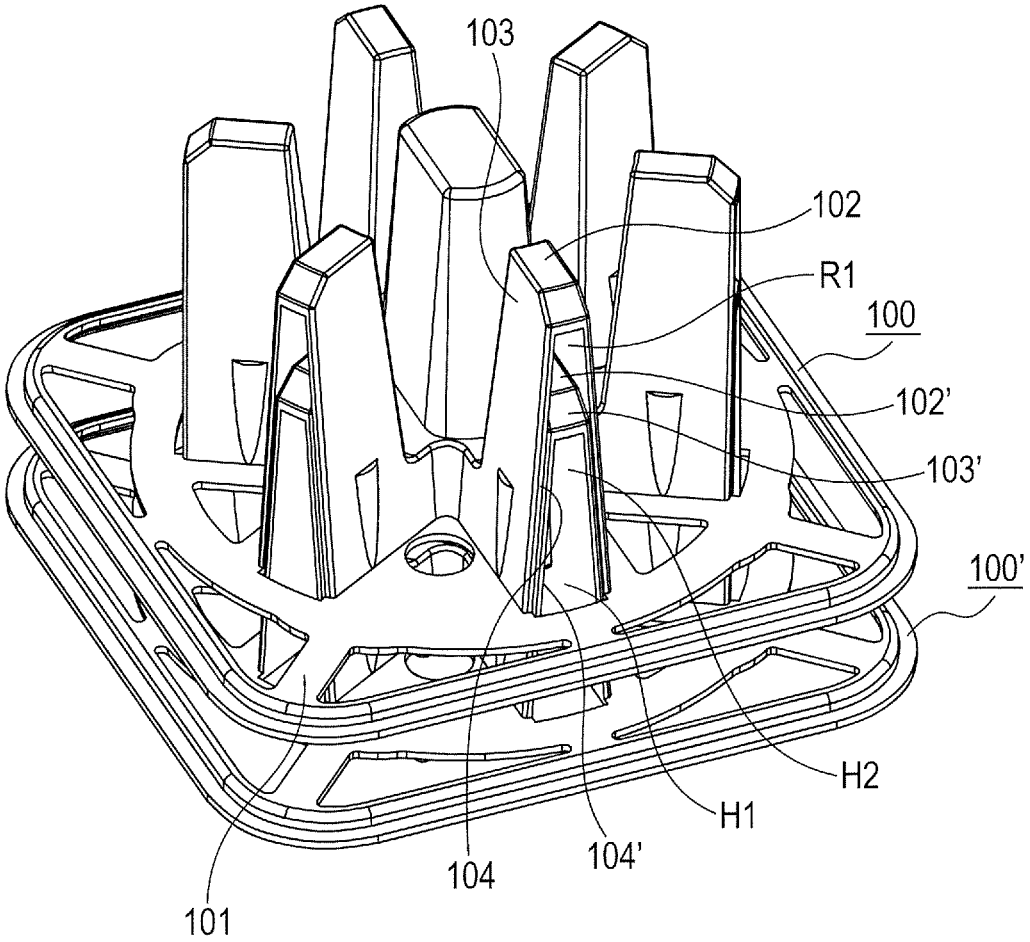
FIG. 4 is a perspective view showing how a plurality of component carrying trays in FIG. 1 are stacked.

As shown in FIG. 4, when the component carrying tray 100 is stacked on an additional component carrying tray 100' carrying no components which has the same shape as the component carrying tray 100, a projection 102' of the additional component carrying tray 100' comes into the hollow part R1 of the main body 103 through the through-hole H1. That is, since the outer shapes of the main bodies 103 and 103' are tapering shapes, the tip end of the projection 102' comes into the hollow part R1 of the main body 103 without interfering with the bottom plate 101.

Here, the tapering shape includes such shapes that the outer shape of the main body 103 is narrower at the tip end than at the base end, for example, a shape that the outer shape of the main body 103 continuously tapers as shown in FIG. 1, and a shape that the outer shape of the main body 103 tapers in stages. The part of the hollow part (cavity part) R1 of the main body 103 which comes into contact with the through-hole H1 may be a cavity having a size equal to or more than the tip end of the main body 103.

An opening H2 is formed in each projection 102 so that when the component carrying tray 100 is stacked on the additional component carrying tray 100', the interference with a regulator 104' of the additional component carrying tray 100' is avoided. This opening H2 may be formed in either the main body 103 or the regulator 104. According to the present first embodiment, the opening H2 is formed in the regulator 104, and the opening H2 is formed to be larger than the regulator 104. The opening H2 formed in the projection 102 is continuous with the through-hole H1 formed in the bottom plate 101.

Thus, since the opening H2 is formed in the projection 102, the projection 102' of the additional component carrying tray 100' smoothly comes into the hollow part (cavity part) R1 of the projection 102, and a plurality of component carrying trays 100 can be densely stacked. Therefore, when a plurality of component carrying trays 100 carrying no components are conveyed, the component carrying trays 100 are piled up so that the conveyance efficiency can be increased. Although two component carrying trays 100 are provided in the case shown in FIG. 4, three or more component carrying trays 100 can be stacked in a similar manner.

According to the present first embodiment, as shown in FIG. 1, the main body 103 has a pair of side-wall plates 111 and 112 which are arranged to face each other and which are slanted relative to the carrying surface 101A of the bottom plate 101 so as to taper toward the tip end. The main body 103 also has a top plate 113 which connects the tip ends of the pair of side-wall plates 111 and 112, and a rear surface plate 114 formed opposite to the opening H2. This rear surface plate 114 is also slanted relative to the carrying surface 101A of the bottom plate 101 so as to taper toward the tip end. The part of the main body 103 perpendicular to the carrying surface 101A is open.

The regulators 104 are formed at the edges (side ends) of the side-wall plates 111 and 112 so that the opening H2 is formed between the pair of side-wall plates 111 and 112.

The top plate 113 has a horizontal part 115, and a draw-in part 116 which ensures operability when the circularly cylindrical components W are carried on the carrying surface 101A. This draw-in part 116 is disposed on the side of the regulator 104 compared to the horizontal part 115, formed at a slant toward the carrying surface 101A compared to the horizontal part 115, and connected to the regulator 104.

According to the present first embodiment, the regulator 104 is formed integrally with the edges of the side-wall plates 111 and 112 and the end of the top plate 113, and is thus substantially U-shaped when seen from the front. The substantially U-shaped regulator 104 is formed at a slant so as to expand from the tip ends (upper ends) of the side-wall plates 111 and 112 toward the base ends (lower ends), in other words, so as to taper from the base ends toward the tip ends with a width substantially equal to the thickness of the side-wall plates 111 and 112.

That is, the regulating surface 104A of the regulator 104 is formed so that the phase is shifted from the tip end toward the base end in a circumferential direction. While the position of the regulating surface 104A to contact the components W varies in the arrow Z direction, the regulating surface 104A comes into surface contact with inside surfaces Wa of the components W at any position. Part of the regulator 104 is formed in the top plate 113. However, when the regulator is omitted in the top plate 113, the regulator is formed in each of the side-wall plates 111 and 112.

Since the pair of side-wall plates 111 and 112 is arranged at a slant according to the present first embodiment, the projection 102' of the additional component carrying tray 100' easily comes into the hollow part R1 of the main body 103, and the opening H2 can be increased in size from the base ends toward the tip ends. Therefore, a plurality of component carrying trays 100 can be more densely stacked.

Since the regulator 104 is formed at the edges (side ends) of the side-wall plates 111 and 112, the components W can be positioned from the base ends toward the tip ends, and more components W can be carried.

Protrusions (steps) 121 are formed on the outer surfaces of the side-wall plates 111 and 112 to prevent the trays from fitting into each other when the additional component carrying trays are stacked, that is, to support the bottom plate of the additional component carrying tray when this additional component carrying tray is stacked.

Although the protrusions 121 are formed in both the side-wall plates 111 and 112 according to the present first embodiment, the protrusion 121 has only to be formed at least one of the side-wall plates 111 and 112, and the protrusion 121 may be only formed in the side-wall plate 111 or the side-wall plate 112.

The component carrying tray 100 further comprises a handle 122 which is disposed in a part surrounded by a plurality of projections 102 and which is formed to project from the bottom plate 101 in the same direction as the projecting direction (arrow Z direction) of a plurality of projections 102. This handle 122 is formed into a tapering hollow shape in the same manner as the projections 102. An unshown through-hole is formed in the part of the bottom plate 101 corresponding to the handle 122, and a handle of the additional component carrying tray comes into this through-hole. This handle 122 permits the component carrying tray 100 to be moved without touching the components W.

A positioning hole 123 to engage with a positioning pin which is a protrusion of a mounting stand is formed in the bottom plate 101. While this positioning hole 123 may be either a recessed hole or a through-hole, positioning hole 123 is a through-hole in the present first embodiment. The positioning hole 123 may be a hole of any shape including a round hole and a square hole as long as the bottom plate 101, that is, the component carrying tray 100 can be positioned. According to the present first embodiment, the positioning hole 123 is a round hole. Since the positioning hole 123 is a round hole, a plurality of positioning holes 123 are preferably provided. The precision of the positioning of the component carrying tray 100 relative to the mounting stand is further improved not only by the shape of the positioning hole 123 but also by having a plurality of positioning holes 123.

Figure 5:
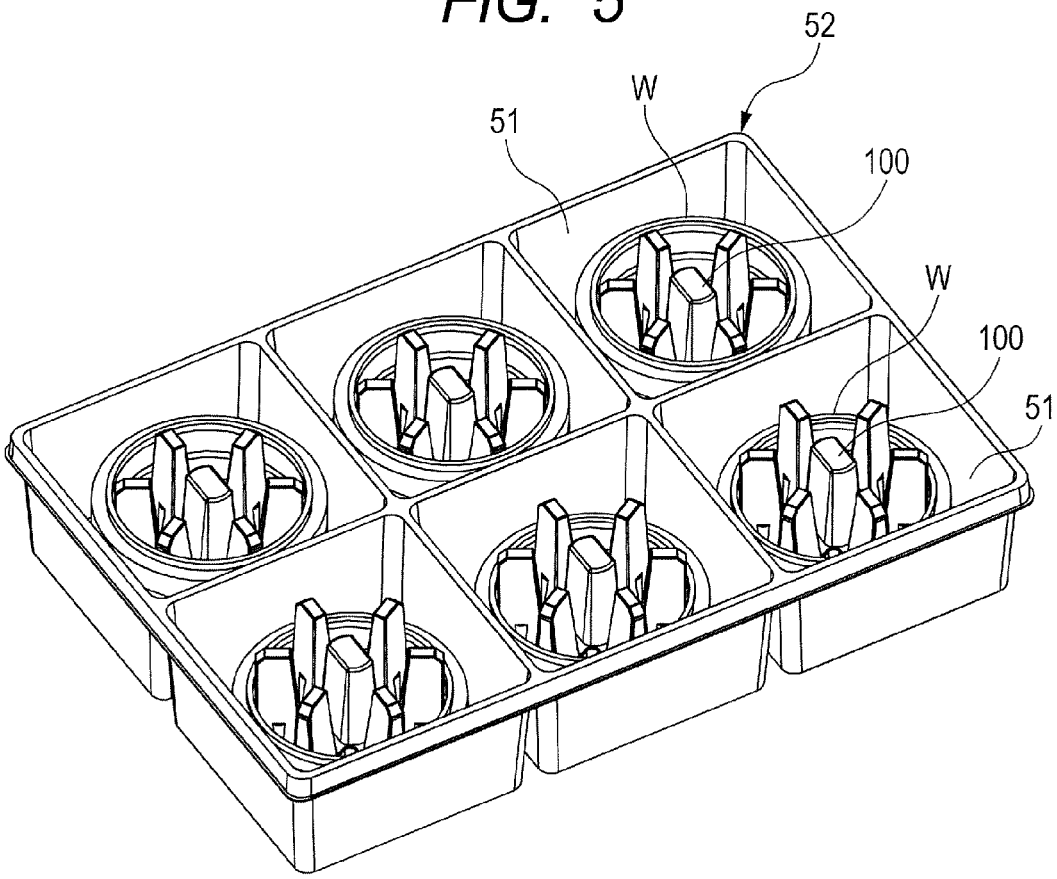
FIG. 5 is a perspective view showing how the component carrying trays in FIG. 1 are housed in a general-purpose tray.

An example of conveying the component carrying tray 100 according to the present first embodiment is described with reference to FIG. 5 and FIG. 6. When the component carrying tray 100 carrying the components W is transported, the component carrying tray 100 is housed in a general-purpose tray 52 having pockets 51 which can house the component carrying trays 100, as shown in FIG. 5. The pockets 51 are formed to have a depth greater than the height of the component carrying tray 100.

Figure 6:
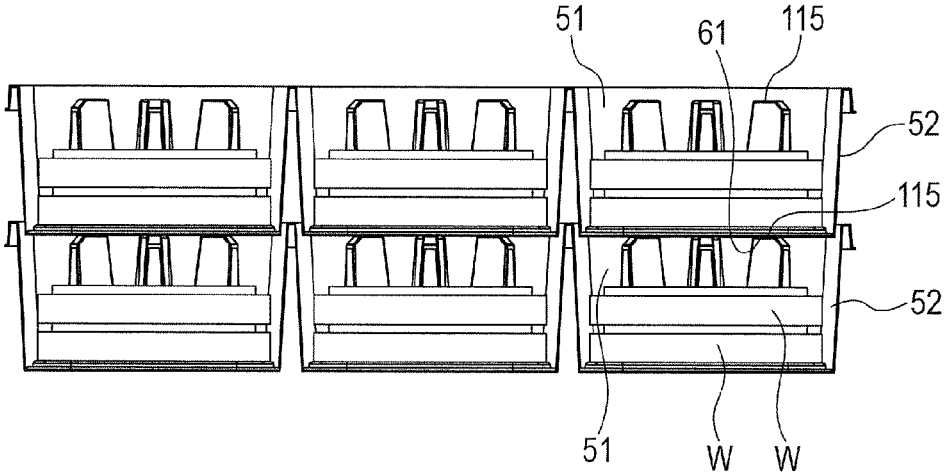
FIG. 6 is a schematic diagram showing how the component carrying trays in FIG. 1 are housed in the general-purpose trays and the general-purpose trays are stacked.

FIG. 6 is a schematic diagram showing how the general-purpose trays 52 housing the component carrying trays 100 are stacked. When the component carrying trays 100 are housed in the general-purpose trays 52 and the general-purpose trays 52 are stacked, a lower surface 61 of the general-purpose tray 52 is supported by the horizontal part 115 of the top plate 113 of the component carrying tray 100 so that no loads are applied to the components W. In addition, the lower surface 61 partly enters the pocket 51, so that the general-purpose trays 52 are fitted into each other, and the general-purpose trays 52 can be stably piled up.

Figure 7:
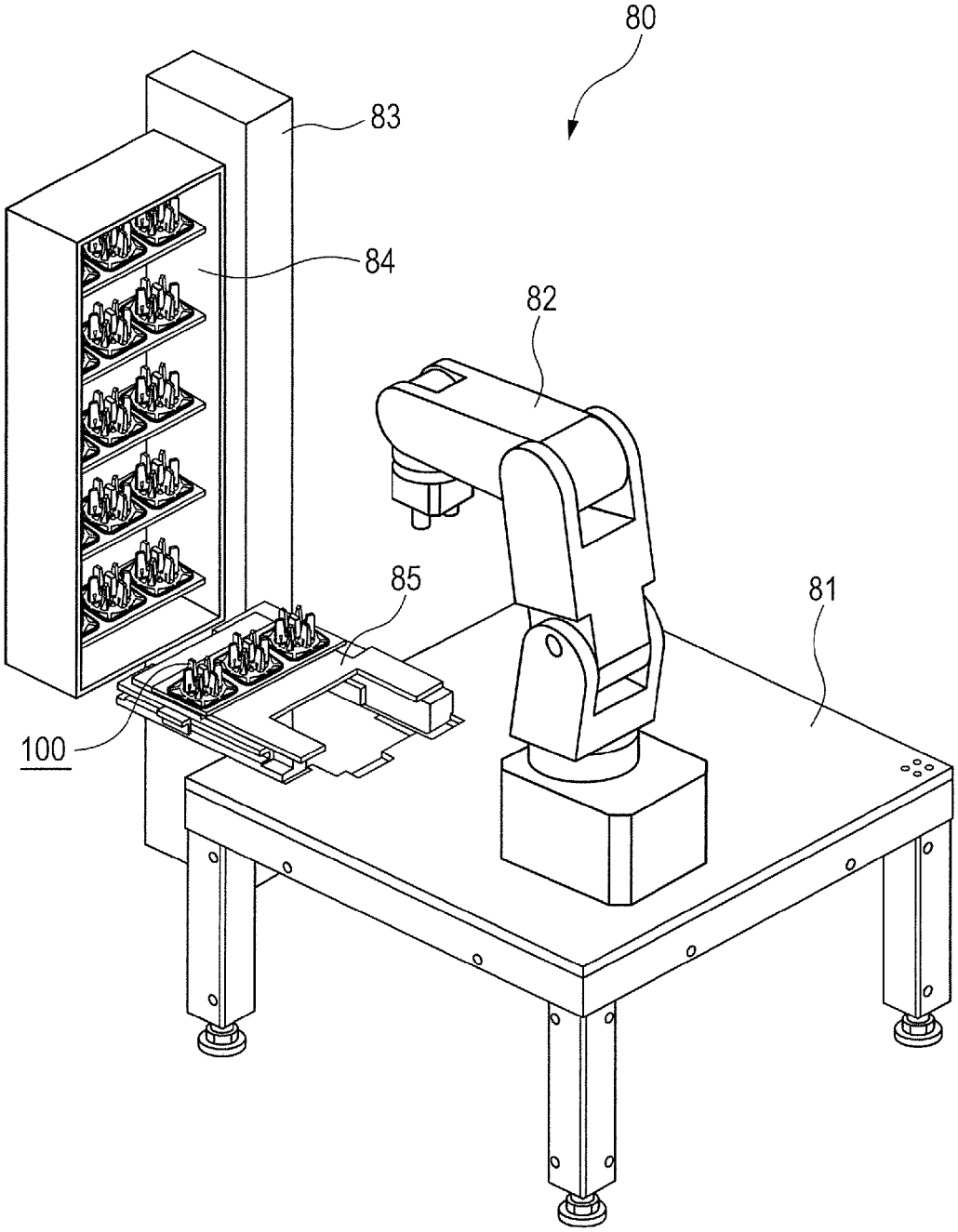
FIG. 7 is a perspective view showing an automatic assembling apparatus.

How the component carrying tray 100 is supplied to an automatic assembling apparatus is described with reference to FIG. 7, FIG. 8A and FIG. 8B. An example of how to supply the component carrying tray 100 to an automatic assembling apparatus 80 is shown in FIG. 7. In FIG. 7, the automatic assembling apparatus 80 comprises a worktable body 81, an assembling robot 82 fixed onto the worktable body 81, a component supplying apparatus 83, a housing 84 of the component carrying trays 100, and a robot operating part 85 which is a mounting stand.

A plurality of component carrying trays 100 carrying a plurality of components W are housed in the housing 84. The component supplying apparatus 83 passes the component carrying tray 100 from the housing 84 to the robot operating part 85. The assembling robot 82 takes out the components W from the component carrying tray 100 passed to the robot operating part 85, and then performs assembly operation.

Figure 8A:
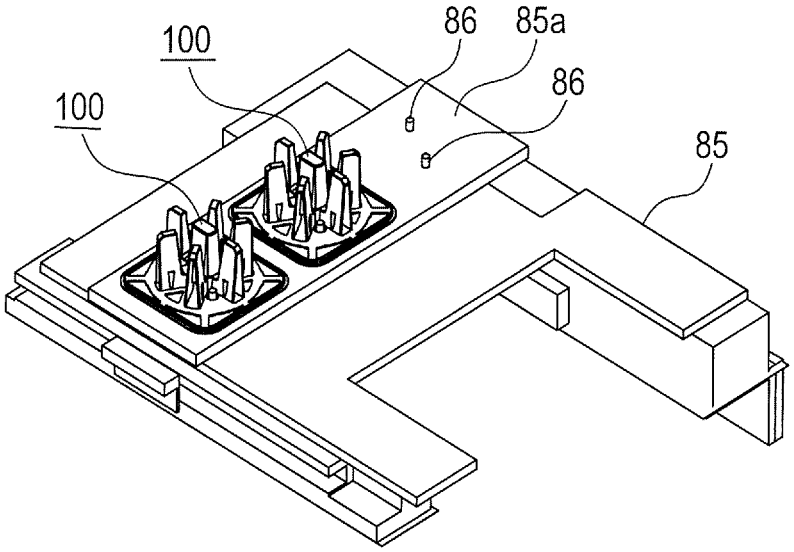
FIG. 8A is a diagram showing how the component carrying tray in FIG. 1 is positioned in a mounting stand.
Figure 8B:
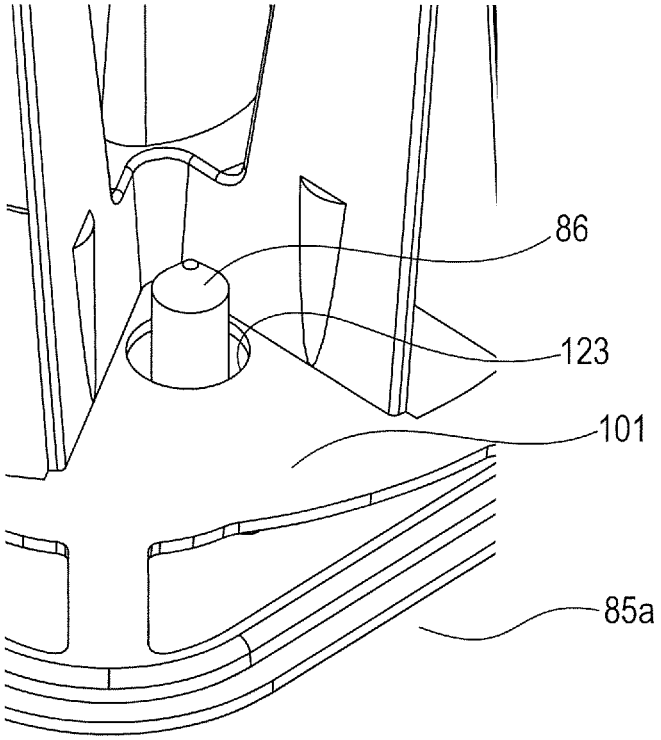
FIG. 8B is a diagram showing how the component carrying tray in FIG. 1 is positioned in a mounting stand.

FIG. 8A is an enlarged view of the robot operating part 85. A positioning pin 86, which is a protrusion to regulate the position of the component carrying tray 100, is provided on an upper surface 85*a* of the robot operating part 85. The component carrying tray 100 passed to the robot operating part 85 is positioned at a prescribed position of the upper surface 85*a* so that the assembling robot 82 acquires the components W from the component carrying tray 100. FIG. 8B is a partial enlarged view of the component carrying tray positioned by the robot operating part 85.

As described above, the positioning hole 123 to engage with the positioning pin 86 is provided in the bottom plate 101 of the component carrying tray 100. The positioning pin 86 is installed in the upper surface 85*a* of the robot operating part 85 at a position corresponding to the positioning hole 123.

The positioning pin 86 provided in the upper surface 85*a* of the robot operating part 85 is inserted into the positioning hole 123 of the component carrying tray 100, so that the component carrying tray 100 is positioned at the prescribed position of the upper surface 85*a*.

As described above, the component carrying tray 100 can uniformly regulate the positioning of a plurality of stacked circularly cylindrical components W because the regulator 104 is formed perpendicularly to the carrying surface 101A. When carrying no components W, a plurality of component carrying trays 100 can be densely stacked. Therefore, it is possible to achieve both the function of uniformly positioning the stacked components W and the function of densely carrying a plurality of component carrying trays 100 carrying no components W. When the component carrying trays 100 contain no components W, the component carrying trays 100 are densely stacked, and conveyance costs of the trays can be reduced accordingly.

When the component carrying tray 100 which can uniformly position and supply the stacked components W is obtained, a supply space necessary to supply the components to the automatic assembling apparatus (robot cell) 80 can be reduced, and many kinds of components can be efficiently supplied to one robot. As a result, the components supplying apparatus 83 in the automatic assembling apparatus 80 can be reduced in size, and apparatus costs can be reduced.

Second Embodiment

Figure 9:
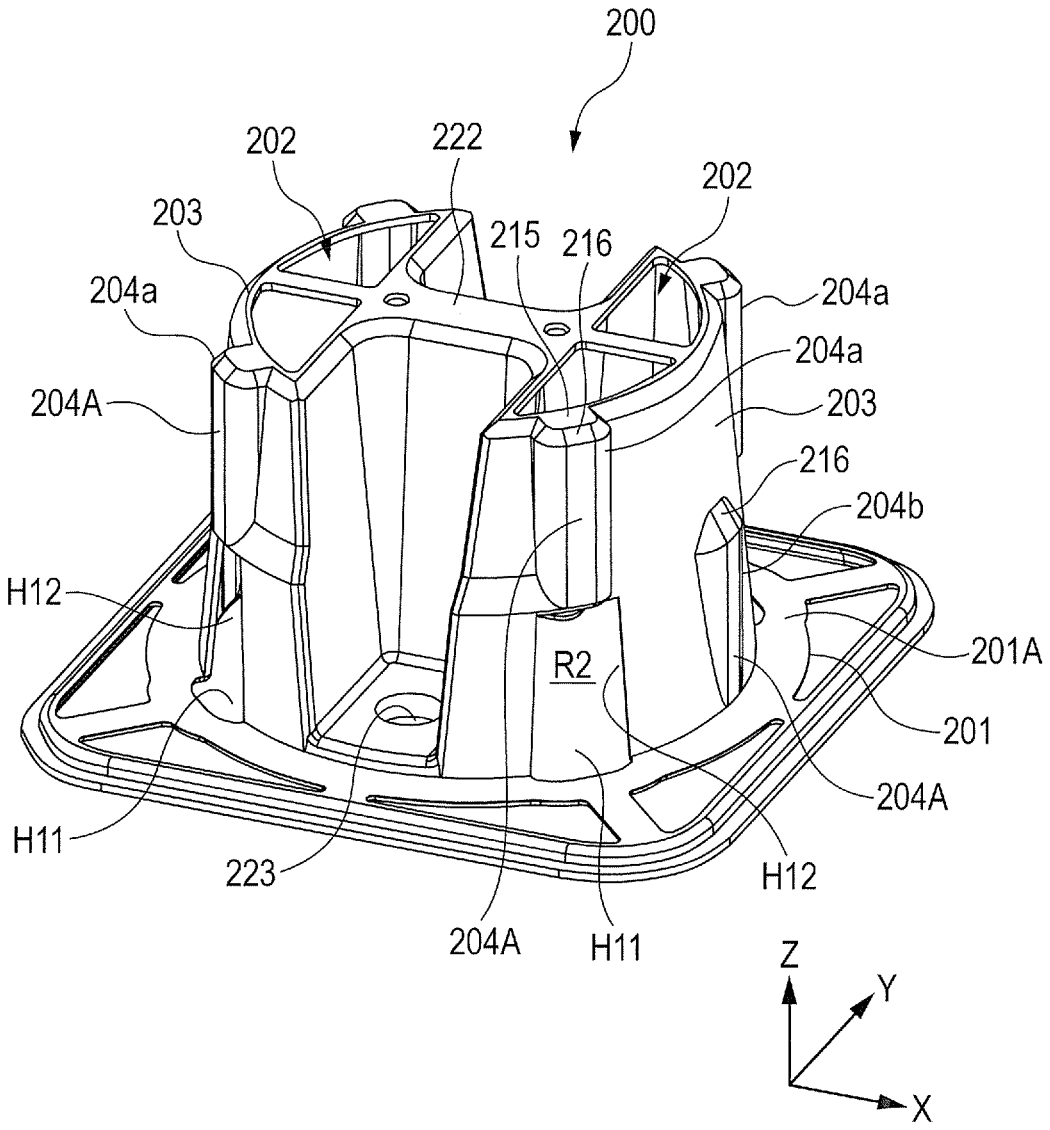
FIG. 9 is a perspective view showing a component carrying tray according to a second embodiment.
Figure 10:
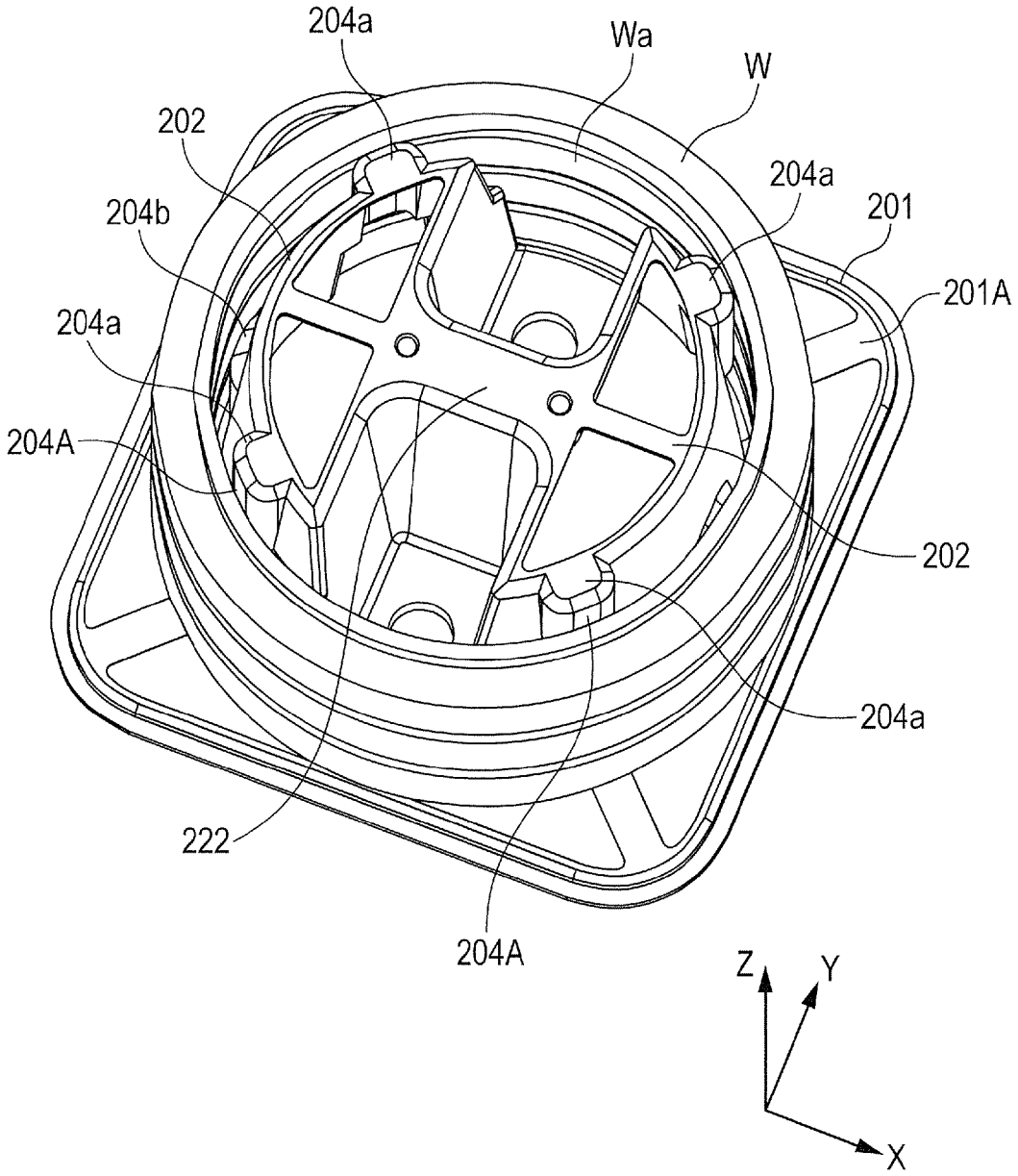
FIG. 10 is a perspective view showing how a plurality of components is carried on the component carrying tray in FIG. 9.
Figure 11:
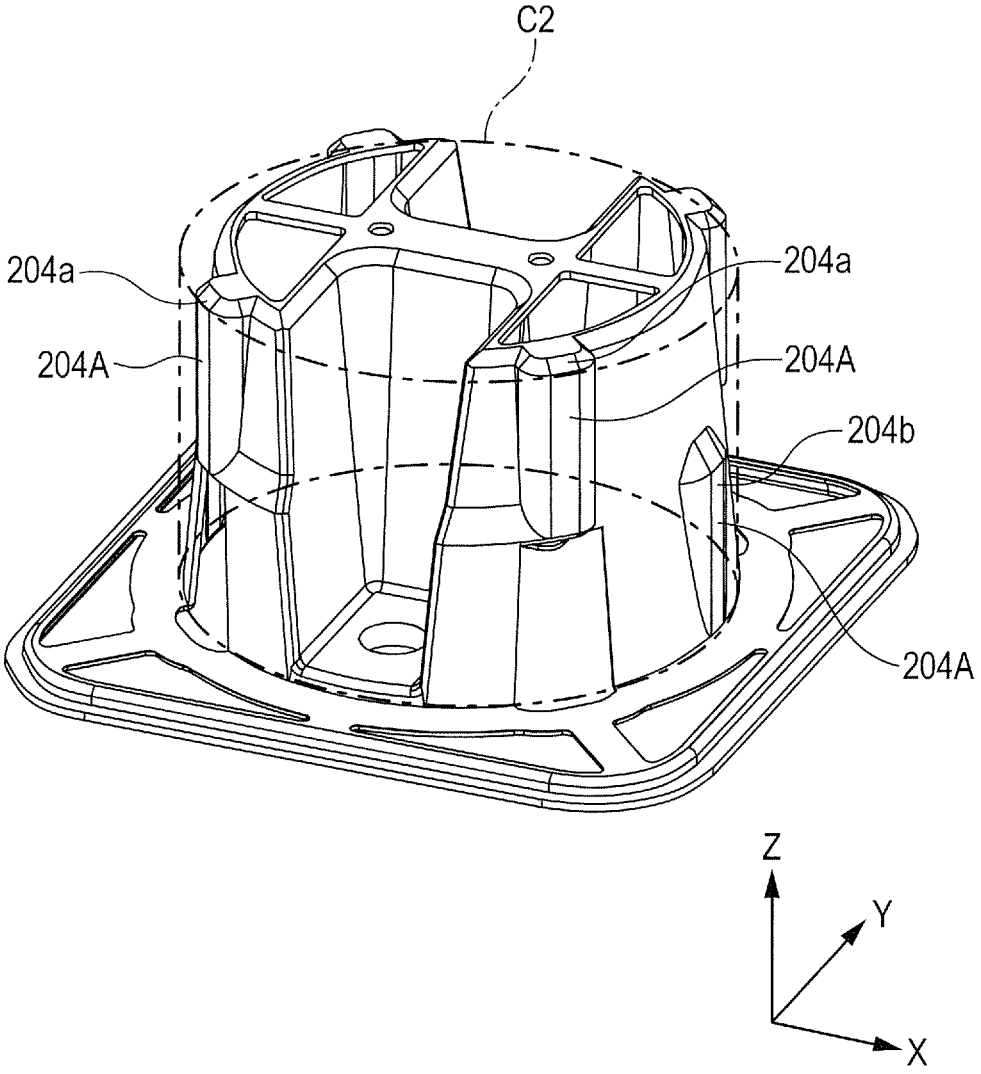
FIG. 11 is a perspective view showing the component carrying tray in which an imaginary cylinder surface along the inside surfaces of a plurality of stacked components is shown.

Hereinafter, a component carrying tray according to a second embodiment of the present invention is described. FIG. 9 is a perspective view showing the component carrying tray according to the second embodiment of the present invention. FIG. 10 is a perspective view showing how a plurality of components is carried on the component carrying tray in FIG. 9. FIG. 11 is a perspective view showing the component carrying tray in which an imaginary cylinder surface along the inside surfaces of a plurality of stacked components is shown.

A component carrying tray 200 comprises a bottom plate 201 having a carrying surface 201A on which a plurality of components W are stacked, and projections 202 formed to project from the carrying surface 201A of the bottom plate 201. The projection 202 has a main body 203, and regulators 204*a* and 204*b* which are formed in the main body 203 and which regulate the position of components W.

The regulator 204*a* is an upper regulator formed in the upper part of the main body 203, and the regulator 204*b* is a lower regulator formed in the lower part of the main body 203. In this way, the regulators 204*a* and 204*b*, which position the stacked components W, are separately arranged in the upper and lower two parts. The regulator 204*b* is located out of alignment with the regulator 204*a* in a circumferential direction.

The component carrying tray 200 has at least one projection 202 and preferably more than one regulator 204. That is, one projection may have a plurality of regulators when the component carrying tray 200 has one projection, whereas each projection may have one or more regulators when the component carrying tray 200 has a plurality of projections. In the present second embodiment, a plurality of (two in FIG. 9) projections 202 are provided, and each projection 202 has a plurality of (two in FIG. 9) regulators 204*a* and one regulator 204*b*. The plurality of projections 202 are spaced out from one another along the components W carried on the carrying surface 201A.

The main body 203 may be formed into a hollow tapering shape. The regulators 204*a* and 204*b* are formed to extend in a direction perpendicular to the carrying surface 201A of the bottom plate 201. That is, the regulators 204*a* and 204*b* are formed to extend in an arrow Z direction intersecting at right angles with an arrow X direction and an arrow Y direction which extend along the carrying surface 201A and which intersect at right angles with each other. The regulators 204*a* and 204*b* contact side surfaces Wa of the components W carried on the carrying surface 201A to regulate the position of components W carried on the carrying surface.

According to the present second embodiment, the regulators 204*a* and 204*b* have regulating surfaces 204A, and the regulating surfaces 204A are perpendicular to the carrying surface 201A. The regulating surfaces 204A of the regulators 204*a* and 204*b* come into surface contact with the side surfaces Wa of the components W carried on the carrying surface 201A.

Here, the components W are formed into a cylindrical shape (specifically, a circularly cylindrical shape). The regulators 204*a* and 204*b* are positioned on the main body 203 and shaped so that the regulating surfaces 204A come into surface contact with the inside surfaces Wa of the components W. In other words, the regulating surfaces 204A of the regulators 204*a* and 204*b* are formed into a shape along the inside surfaces Wa of the components W. That is, as shown in FIG. 11, the regulating surfaces 204A of the regulators 204*a* and 204*b* are formed into a shape along an imaginary cylinder surface C2 so that the regulating surfaces 204A come into surface contact with the imaginary cylinder surface C2 along the inside surfaces Wa of a plurality of stacked components W. The regulating surface 204A of the regulator 204*a* and the regulating surface 204A of the regulator 204*b* are located out of phase in the circumferential direction.

Thus, a plurality of components W stacked on the carrying surface 201A are regulated by contacting the regulators 204*a* and 204*b*, and are precisely positioned at the same position in the arrow X direction and the arrow Y direction. In particular, a plurality of components W stacked on the carrying surface 201A are regulated by surface contact with the regulating surface 204A, and are therefore precisely positioned.

A through-hole H11 is formed in the bottom plate 201 at a position corresponding to a hollow part (cavity part) R2 of the main body 203 so that a projection of an additional component carrying tray comes into the through-hole H11.

Figure 12:
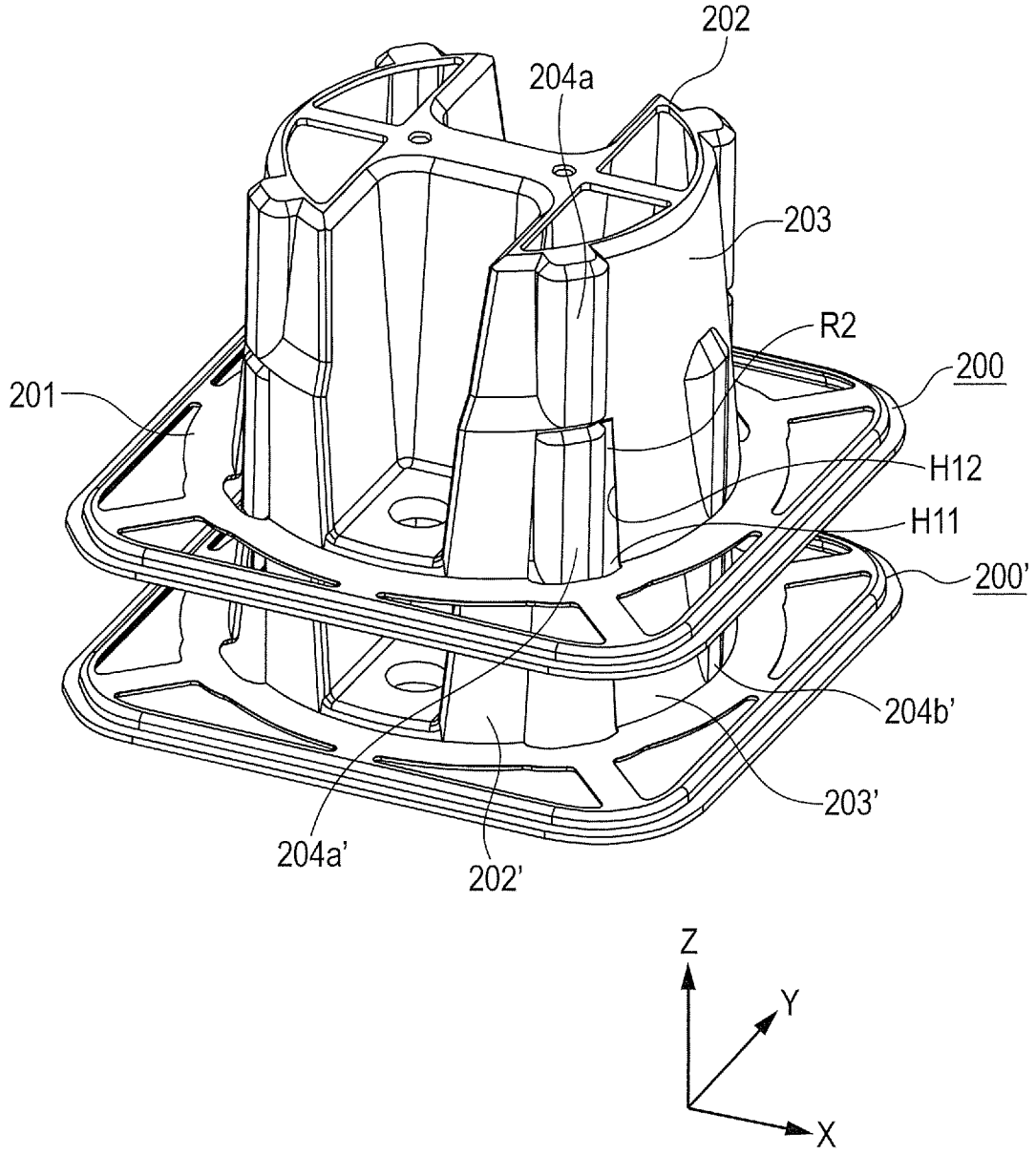
FIG. 12 is a perspective view showing how a plurality of component carrying trays in FIG. 9 is stacked.

As shown in FIG. 12, when the component carrying tray 200 is stacked on an additional component carrying tray 200' carrying no components which has the same shape as the component carrying tray 200, a projection 202' of the additional component carrying tray 200' comes into the hollow part R2 of the main body 203 through the through-hole H11. That is, since the outer shapes of the main bodies 203 and 203' are tapering shapes, the tip end of the projection 202' comes into the hollow part R2 of the main body 203 without interfering with the bottom plate 201.

Here, the tapering shape includes such shapes that the outer shape of the main body 203 is narrower at the tip end than at the base end, for example, a shape that the outer shape of the main body 203 continuously tapers as shown in FIG. 9, and a shape that the outer shape of the main body 203 tapers in stages. The part of the hollow part (cavity part) R2 of the main body 203 which comes into contact with the through-hole H11 may be a cavity having a size equal to or more than the tip end of the main body 203.

An opening H12 is formed in each projection 202 so that when the component carrying tray 200 is stacked on the additional component carrying tray 200', the interference with a regulator 204*a*' of the additional component carrying tray 200' is avoided. This opening H12 may be formed in either the main body 203 or the regulator 204*a*. According to the present second embodiment, the opening H12 is formed in the main body 203. The opening H12 formed in the projection 202 is continuous with the through-hole H11 formed in the bottom plate 201.

Thus, since the opening H12 is formed in the projection 202, the projection 202' of the additional component carrying tray 200' smoothly comes into the hollow part (cavity part) R2 of the projection 202, and a plurality of component carrying trays 200 can be densely stacked. Therefore, when a plurality of component carrying trays 200 carrying no components are conveyed, the component carrying trays 200 are piled up so that the conveyance efficiency can be increased. Although two component carrying trays 200 are provided in the case shown in FIG. 12, three or more component carrying trays 200 can be stacked in a similar manner.

According to the present second embodiment, the opening H12 is formed in the lower part of the regulator 204*a* in the main body 203. Therefore, when the regulator 204*a*' which is an upper regulator of the additional component carrying tray 200' has come into the hollow part R2 of the main body 203 of the projection 202 of the component carrying tray 200, it is possible to avoid outward projection of the regulator 204*a*' from the opening H12 and the interference of the regulator 204*a*' with the main body 203.

A regulator 204*b*' which is a lower regulator of the additional component carrying tray 200' does not come into the hollow part R2 of the main body 203 of the projection 202 of the component carrying tray 200, and contacts the bottom plate 201 of the component carrying tray 200 and thus supports the component carrying tray 200.

The regulator 204*a* has a horizontal part 215 which is level with the tip end of the main body 203, and a draw-in part 216 which ensures operability when the circularly cylindrical components W are carried on the carrying surface 201A, as shown in FIG. 9. This draw-in part 216 is formed at a slant toward the carrying surface 201A compared to the horizontal part 215, and is connected to the regulating surface 204A. The regulator 204*b* also has a draw-in part 216 connected to the regulating surface 204A.

The component carrying tray 200 further comprises a handle 222 which is disposed in a part surrounded by a plurality of projections 202 and which is formed to project from the bottom plate 201 in the same direction as the projecting direction (arrow Z direction) of a plurality of projections 202. This handle 222 is formed into a tapering hollow shape in the same manner as the projections 202. An unshown through-hole is formed in the part of the bottom plate 201 corresponding to the handle 222, and a handle of the additional component carrying tray comes into this through-hole. This handle 222 permits the component carrying tray 200 to be moved without touching the components W. According to the present second embodiment, the handle 222 is formed integrally with two projections 202.

A positioning hole 223 to engage with a positioning pin which is a protrusion of a mounting stand is formed in the bottom plate 201. While this positioning hole 223 may be either a recessed hole or a through-hole, the positioning hole 223 is a through-hole in the present second embodiment. The positioning hole 223 may be a hole of any shape including a round hole and a square hole as long as the bottom plate 201, that is, the component carrying tray 200 can be positioned. According to the present second embodiment, the positioning hole 223 is a round hole. Since the positioning hole 223 is a round hole, a plurality of positioning holes 223 are preferably provided. The precision of the positioning of the component carrying tray 200 relative to the mounting stand is further improved not only by the shape of the positioning hole 223 but also by the provision of a plurality of positioning holes 223.

As described above, the component carrying tray 200 can uniformly regulate the positioning of a plurality of stacked circularly cylindrical components W because the regulators 204*a* and 204*b* are formed perpendicularly to the carrying surface 201A. When carrying no components W, a plurality of component carrying trays 200 can be densely stacked. Therefore, it is possible to achieve both the function of uniformly positioning the stacked components W and the function of densely carrying a plurality of trays 200 carrying no components W. When the component carrying trays 200 contain no components W, the component carrying trays 200 are densely stacked, and conveyance costs of the trays can be reduced accordingly.

When the component carrying tray 200 which can uniformly position and supply the stacked components W is obtained, a supply space necessary to supply the components to the automatic assembling apparatus (robot cell) can be reduced, and many kinds of components can be efficiently supplied to one robot. As a result, a components supplying apparatus in the automatic assembling apparatus can be reduced in size, and apparatus costs can be reduced.

Third Embodiment

Figure 13:
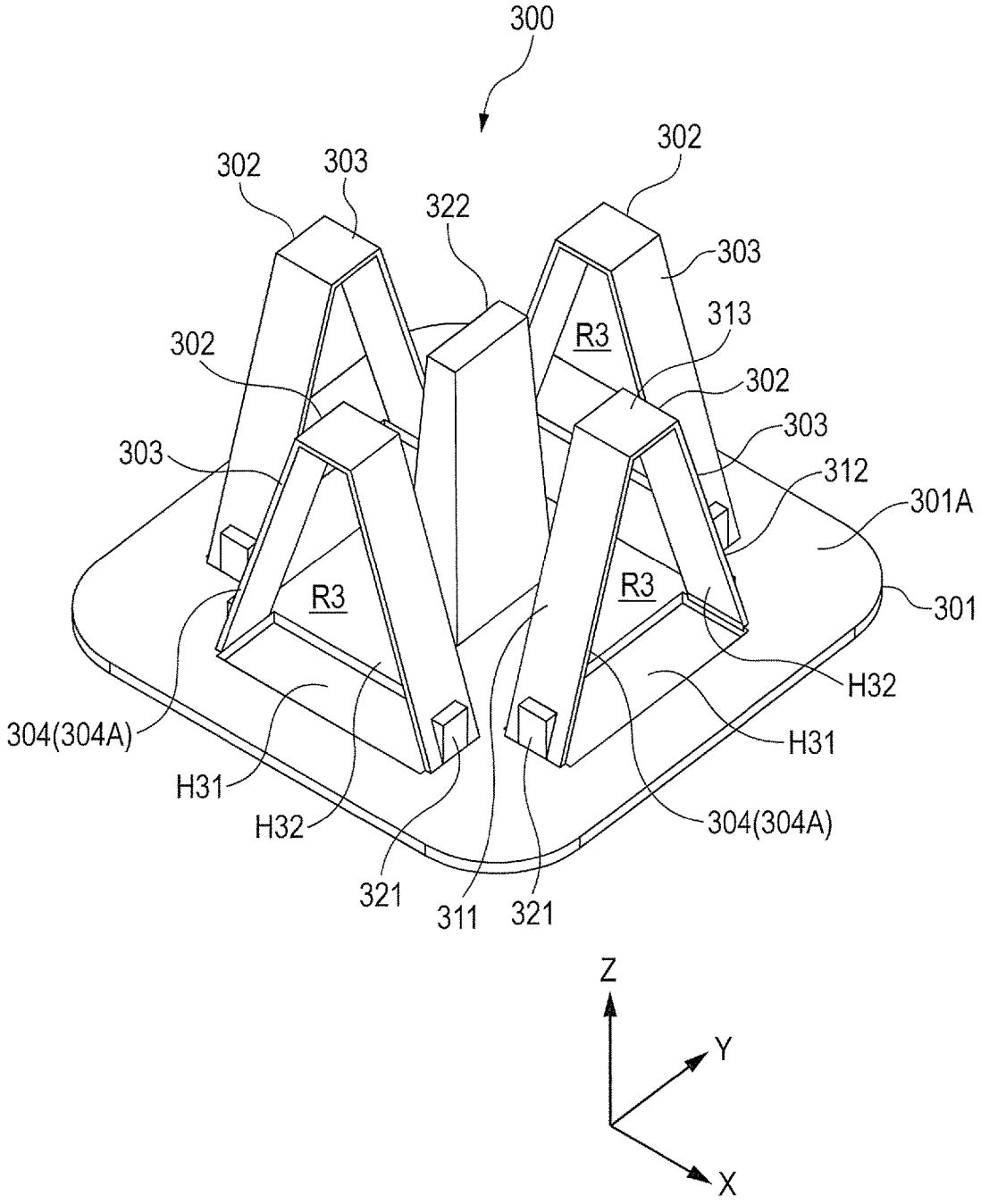
FIG. 13 is a perspective view showing a component carrying tray according to a third embodiment.
Figure 14:
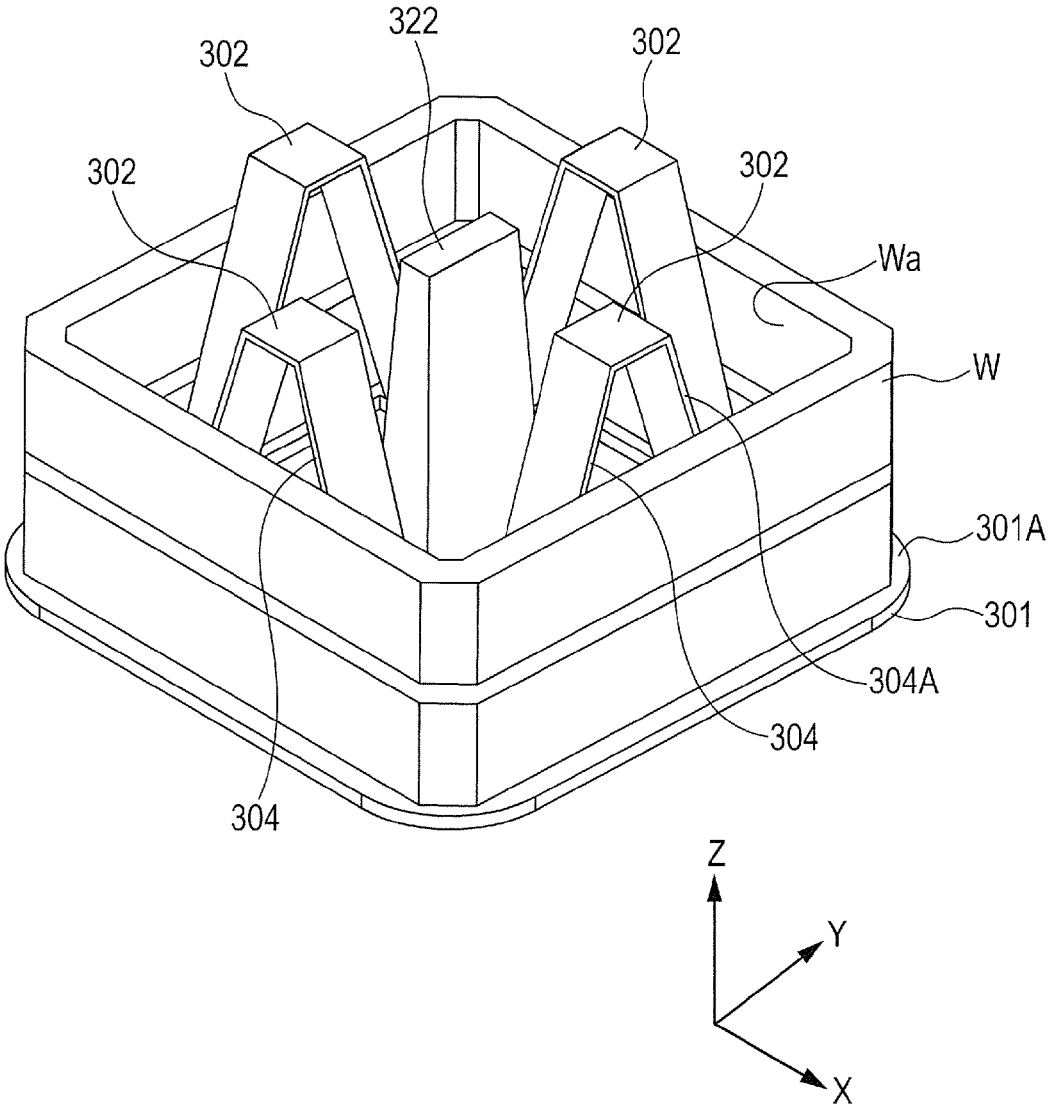
FIG. 14 is a perspective view showing how a plurality of components is carried on the component carrying tray in FIG. 13.
Figure 15:
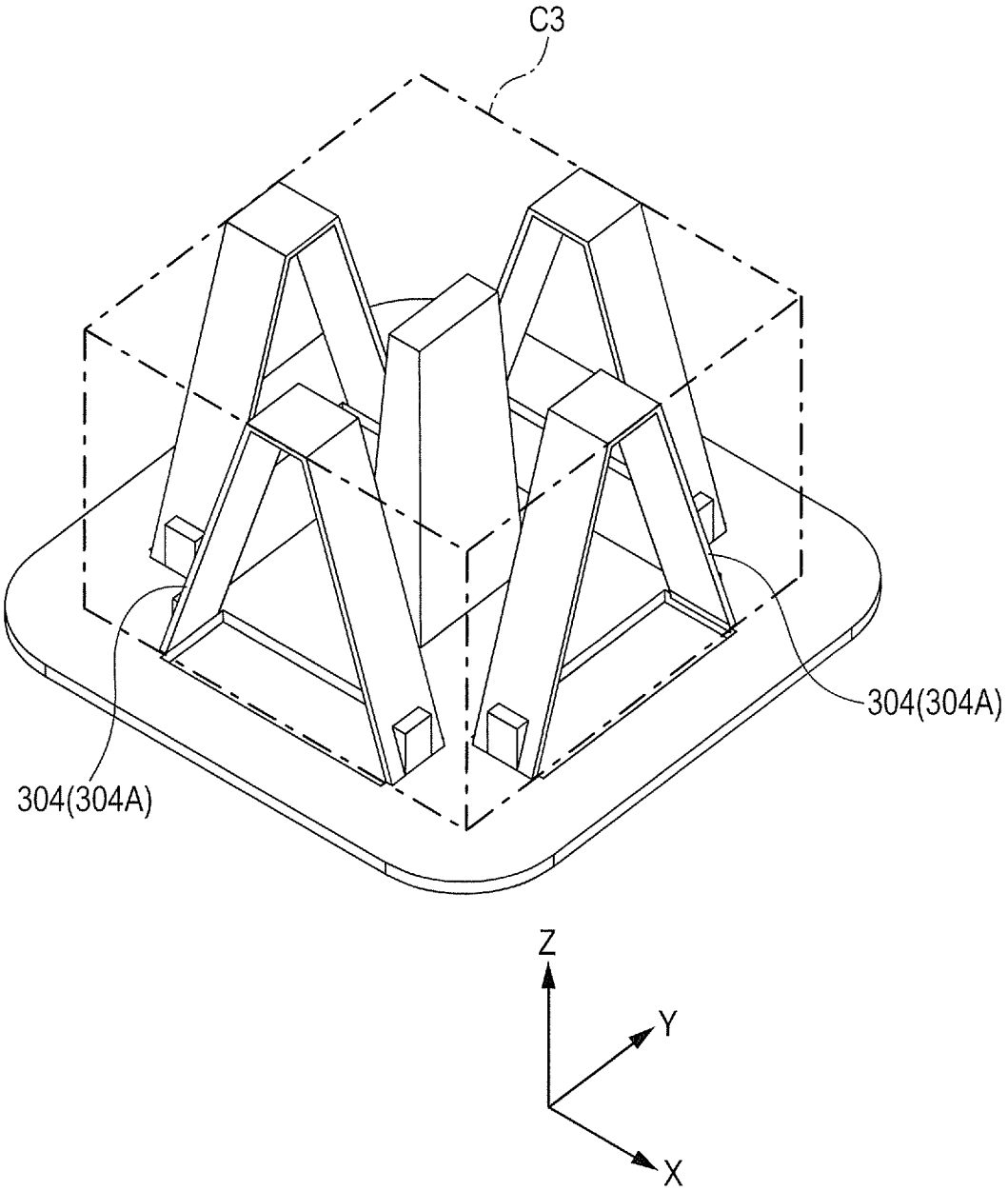
FIG. 15 is a perspective view showing the component carrying tray in which an imaginary rectangular cylinder surface along the inside surfaces of a plurality of stacked components is shown.

Hereinafter, a component carrying tray according to a third embodiment of the present invention is described. Although the cylindrical components are circularly cylindrical components in the case described above according to the first embodiment, the components are not limited to this shape and may have any shape. Cubic components are an example of components having a different shape. FIG. 13 is a perspective view showing the component carrying tray according to the third embodiment of the present invention. FIG. 14 is a perspective view showing how a plurality of components is carried on the component carrying tray in FIG. 13. FIG. 15 is a perspective view showing the component carrying tray in which an imaginary rectangular cylinder prism surface along the inside surfaces of a plurality of stacked components is shown.

A component carrying tray 300 comprises a bottom plate 301 having a carrying surface 301A on which a plurality of components W are stacked, and projections 302 formed to project from the carrying surface 301A of the bottom plate 301. The projection 302 has a main body 303, and a regulator 304 which is formed in the main body 303 and which regulates the components W. According to the present third embodiment, a plurality of (four in FIG. 13) projections 302 are provided, and each projection 302 has one regulator 304. The plurality of projections 302 are spaced out from one another along the components W carried on the carrying surface 301A.

The main body 303 is formed into a hollow tapering shape. The regulator 304 is formed to extend in a direction perpendicular to the carrying surface 301A of the bottom plate 301. That is, the regulator 304 is formed to extend in an arrow Z direction intersecting at right angles with an arrow X direction and an arrow Y direction which extend along the carrying surface 301A and which intersect at right angles with each other. The regulator 304 contacts side surfaces Wa of the components W carried on the carrying surface 301A to regulate the components W carried on the carrying surface. According to the present third embodiment, the regulator 304 is formed to extend from a base end (lower end) to a tip end (upper end) of the main body 303 integrally with the main body 303.

According to the present third embodiment, the regulator 304 has a regulating surface 304A, and the regulating surface 304A is perpendicular to the carrying surface 301A. The regulating surface 304A of the regulator 304 comes into surface contact with the side surfaces Wa of the components W.

The components W are formed into a cylindrical shape (specifically, a cubic shape). The regulator 304 is positioned on the main body 303 and shaped so that the regulating surface 304A comes into surface contact with the inside surfaces Wa of the components W. In other words, the regulating surface 304A of the regulator 304 is formed into a shape along the inside surfaces Wa of the components W. That is, as shown in FIG. 15, the regulating surface 304A of the regulator 304 is formed into a shape along an imaginary rectangular prism surface C3 so that the regulating surface 304A comes into surface contact with the imaginary prism surface C3 along the inside surfaces Wa of a plurality of stacked components W.

Thus, a plurality of components W stacked on the carrying surface 301A are regulated by contacting the regulator 304, and are precisely positioned at the same position in the arrow X direction and the arrow Y direction. In particular, a plurality of components W stacked on the carrying surface 301A are regulated by surface contact with the regulating surface 304A, and are therefore precisely positioned.

A through-hole H31 is formed in the bottom plate 301 at a position corresponding to a hollow part (cavity part) R3 of the main body 303 so that a projection of an additional component carrying tray comes into the through-hole H31.

Figure 16:
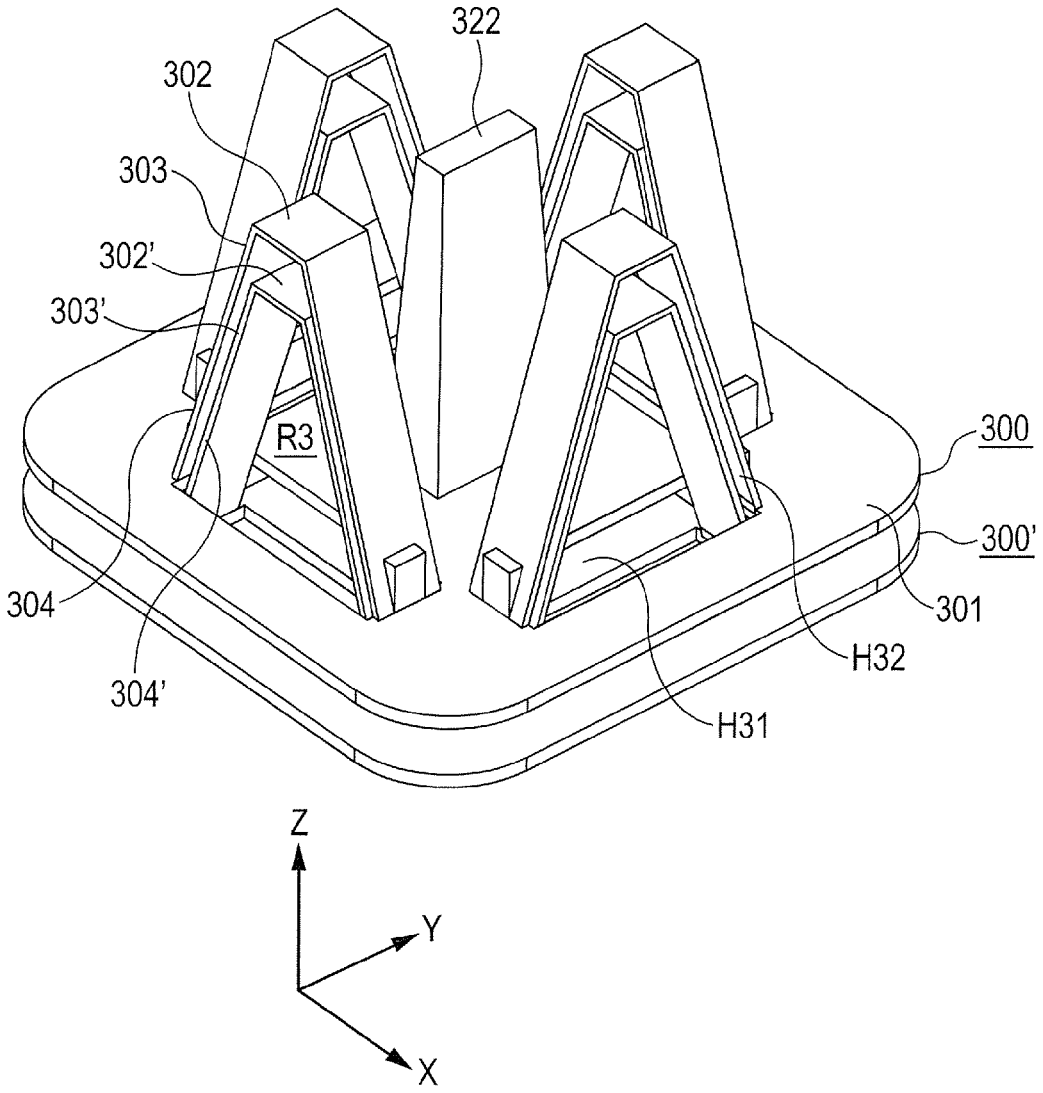
FIG. 16 is a perspective view showing how a plurality of component carrying trays in FIG. 13 is stacked.

As shown in FIG. 16, when the component carrying tray 300 is stacked on an additional component carrying tray 300' carrying no components which has the same shape as the component carrying tray 300, a projection 302' of the additional component carrying tray 300' comes into the hollow part R3 of the main body 303 through the through-hole H31. That is, since the outer shapes of the main bodies 303 and 303' are tapering shapes, the tip end of the projection 302' comes into the hollow part R3 of the main body 303 without interfering with the bottom plate 301.

Here, the tapering shape includes such shapes that the outer shape of the main body 303 is narrower at the tip end than at the base end, for example, a shape that the outer shape of the main body 303 continuously tapers as shown in FIG. 13, and a shape that the outer shape of the main body 303 tapers in stages. The part of the hollow part (cavity part) R3 of the main body 303 which comes into contact with the through-hole H31 may be a cavity having a size equal to or more than the tip end of the main body 303.

An opening H32 is formed in each projection 302 so that when the component carrying tray 300 is stacked on the additional component carrying tray 300', the interference with a regulator 304' of the additional component carrying tray 300' is avoided. This opening H32 is formed in the regulator 304. The opening H32 formed in the projection 302 is continuous with the through-hole H31 formed in the bottom plate 301.

Thus, since the opening H32 is formed in the projection 302, the projection 302' of the additional component carrying tray 300' smoothly comes into the hollow part (cavity part) R3 of the projection 302, and a plurality of component carrying trays 300 can be densely stacked. Therefore, when a plurality of component carrying trays 300 carrying no components are conveyed, the component carrying trays 300 are piled up so that the conveyance efficiency can be increased. Although two component carrying trays 300 are provided in the case shown in FIG. 14, three or more component carrying trays 300 can be carried in a similar manner.

According to the present third embodiment, as shown in FIG. 13, the main body 303 has a pair of side-wall plates 311 and 312 which are arranged to face each other and which are slanted relative to the carrying surface 301A of the bottom plate 301 so as to taper toward the tip end. The main body 303 also has a top plate 313 which connects the tip ends of the pair of side-wall plates 311 and 312. The surface opposite to the regulator 304 is also open. That is, the part of the main body 303 perpendicular to the carrying surface 301A is open.

The regulators 304 are formed at the edges (side ends) of the side-wall plates 311 and 312 so that the opening H32 is formed between the pair of side-wall plates 311 and 312.

According to the present third embodiment, the regulator 304 is formed integrally with the edges of the side-wall plates 311 and 312 and the end of the top plate 313, and is thus substantially U-shaped when seen from the front. The substantially U-shaped regulator 304 is formed at a slant so as to expand from the tip ends (upper ends) of the side-wall plates 311 and 312 toward the base ends (lower ends), in other words, so as to taper from the base ends toward the tip ends with a width substantially equal to the thickness of the side-wall plates 311 and 312.

That is, the regulating surface 304A of the regulator 304 is formed so that the phase is shifted from the tip end toward the base end in the perimetrical direction. While the position of the regulating surface 304A to contact the components W varies in the arrow Z direction, the regulating surface 304A comes into surface contact with inside surfaces Wa of the components W at any position. Part of the regulator 304 is formed in the top plate 313. However, when the regulator is omitted in the top plate 313, the regulator is formed in each of the side-wall plates 311 and 312.

Since the pair of side-wall plates 311 and 312 are arranged at a slant according to the present third embodiment, the projection 302' of the additional component carrying tray 300' easily comes into the hollow part R3 of the main body 303, and the opening H32 can be increased in size from the base ends toward the tip ends. Therefore, a plurality of component carrying trays 300 can be more densely stacked.

Since the regulator 304 is formed at the edges (side ends) of the side-wall plates 311 and 312, the components W can be positioned from the base end to the tip end, and more components W can be carried.

Protrusions (steps) 321 are formed in the outer surfaces of the side-wall plates 311 and 312 to prevent the trays from fitting into each other when the additional component carrying trays are stacked, that is, to support the bottom plate of the additional component carrying tray when this additional component carrying tray is carried.

Although the protrusions 321 are formed in both the side-wall plates 311 and 312 according to the present third embodiment, the protrusion 321 may be formed at least one of the side-wall plates 311 and 312, and the protrusion 321 may be formed in the side-wall plate 311 or the side-wall plate 312.

The component carrying tray 300 further comprises a handle 322 which is disposed in a part surrounded by a plurality of projections 302 and which is formed to project from the bottom plate 301 in the same direction as the projecting direction (arrow Z direction) of a plurality of projections 302. This handle 322 is formed into a tapering hollow shape in the same manner as the projections 302. An unshown through-hole is formed in the part of the bottom plate 301 corresponding to the handle 322, and a handle of the additional component carrying tray comes into this through-hole. This handle 322 permits the component carrying tray 300 to be moved without touching the components W.

As described above, the components carried on the component carrying tray are not limited to circularly cylindrical components. If the regulator 304 of the component carrying tray 300 is provided in accordance with the inside surfaces Wa of the components W, advantageous effects similar to those according to the first embodiment described above can be obtained for components other than the circularly cylindrical components.

Fourth Embodiment

Hereinafter, a component carrying tray according to a fourth embodiment of the present invention is described. Although the regulator 304 is formed at a position to contact the inside surfaces Wa of the cylindrically formed components W in the case described above according to the third embodiment, this is not a limitation.

Figure 17:
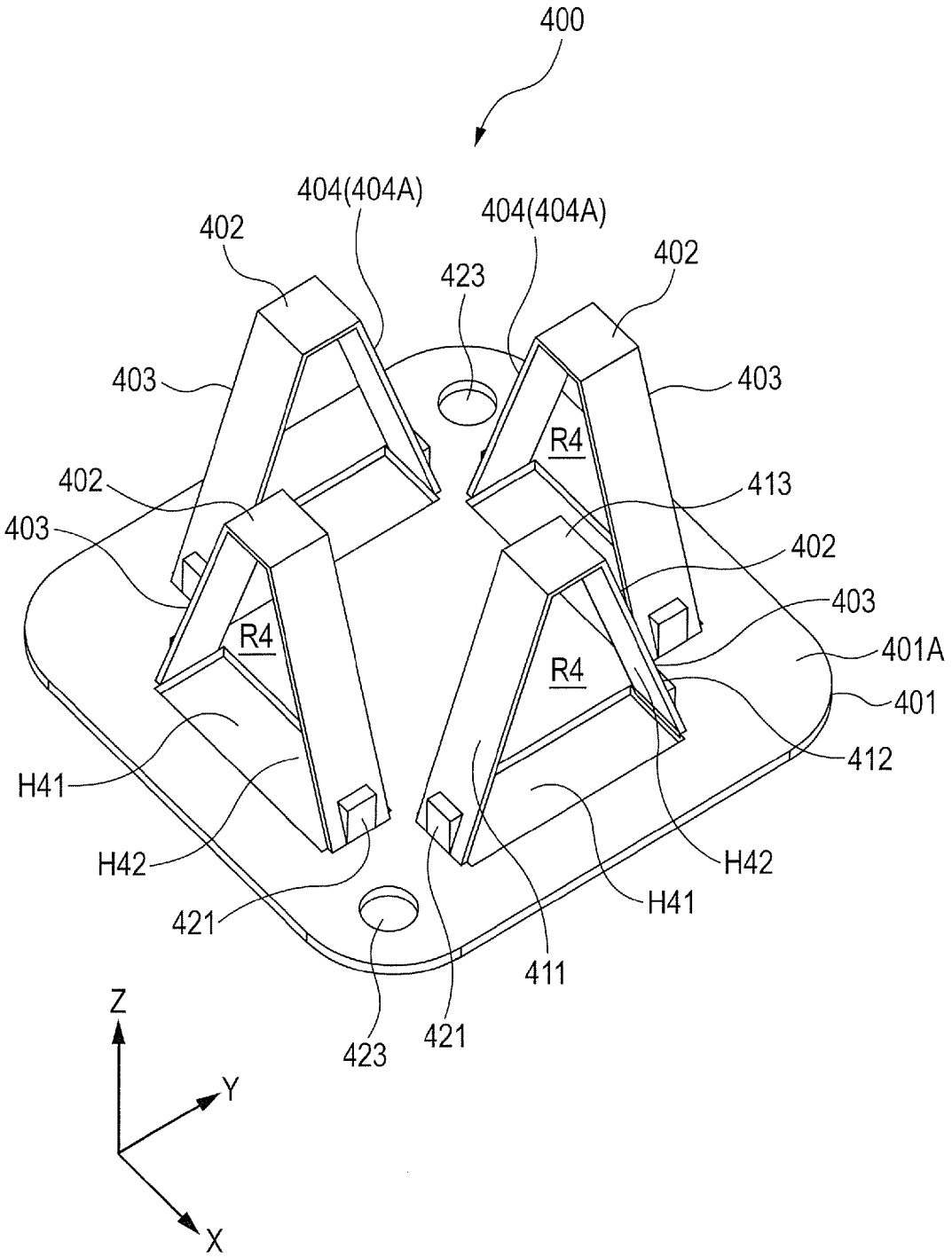
FIG. 17 is a perspective view showing a component carrying tray according to a fourth embodiment.
Figure 18:
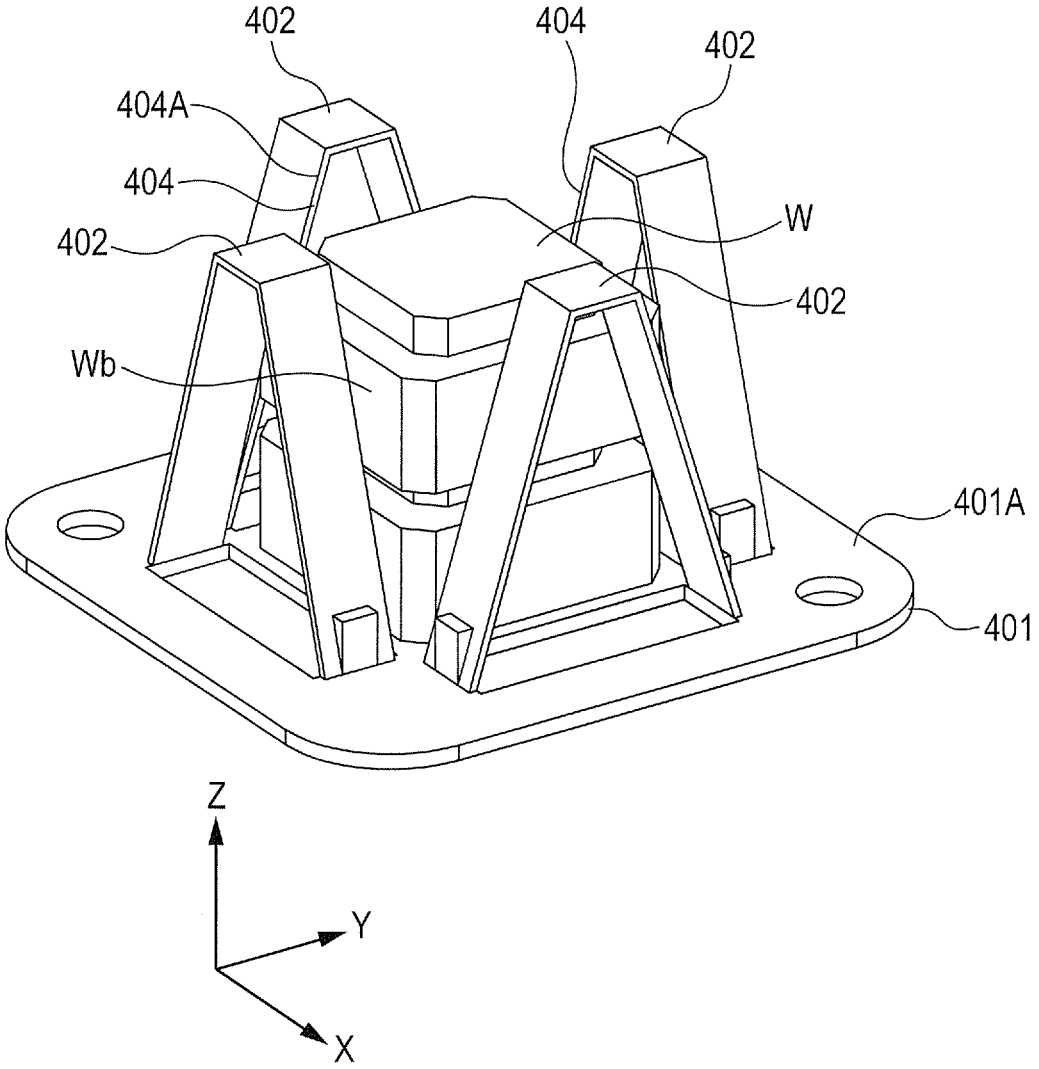
FIG. 18 is a perspective view showing how a plurality of components is carried on the component carrying tray in FIG. 17.
Figure 19:
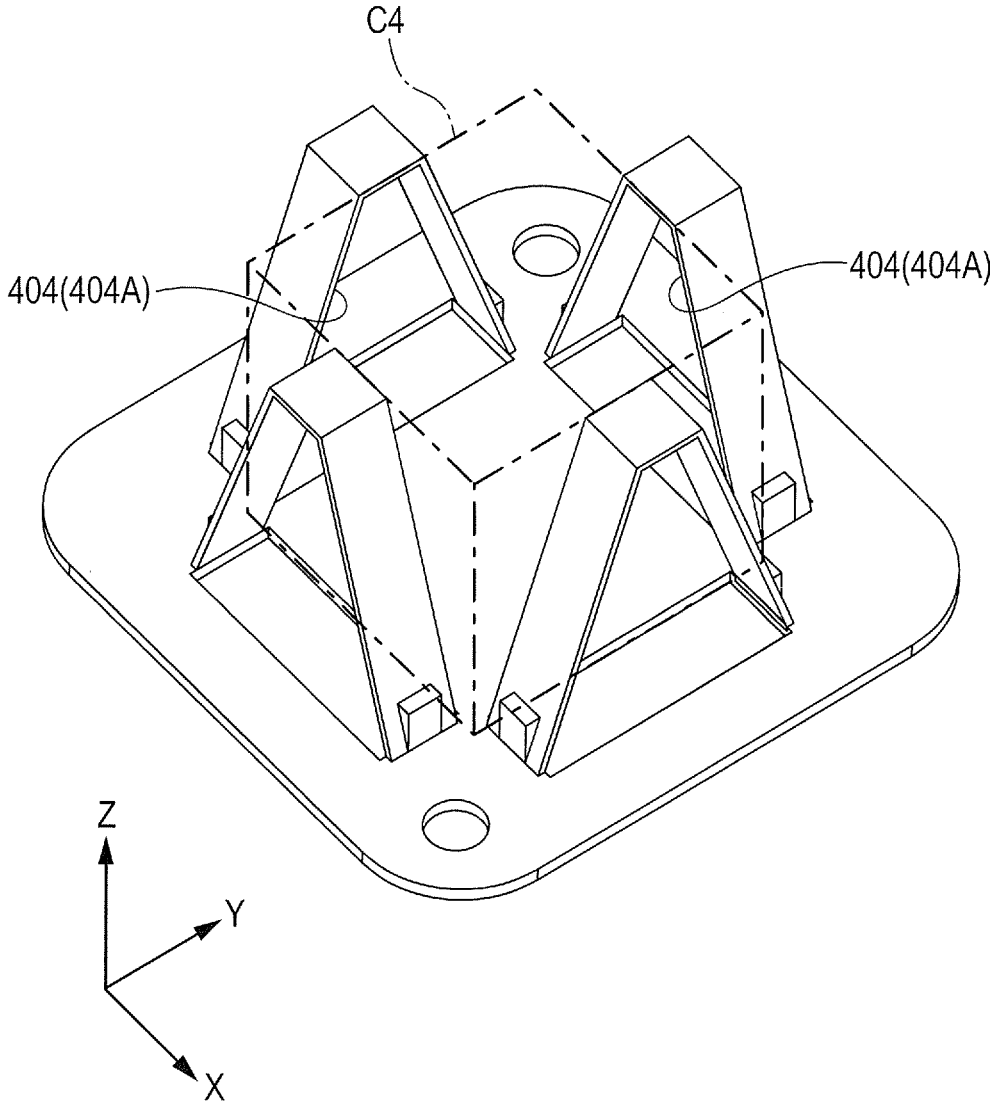
FIG. 19 is a perspective view showing the component carrying tray in which an imaginary rectangular cylinder surface along the inside surfaces of a plurality of stacked components is shown.

According to the fourth embodiment, cubic components are described as components having a different shape. FIG. 17 is a perspective view showing a component carrying tray according to a fourth embodiment of the present invention. FIG. 18 is a perspective view showing how a plurality of components is carried on the component carrying tray in FIG. 17. FIG. 19 is a perspective view showing the component carrying tray in which an imaginary rectangular prism surface along the outside surfaces of a plurality of stacked components is shown.

A component carrying tray 400 comprises a bottom plate 401 having a carrying surface 401A on which a plurality of components W are stacked, and projections 402 formed to project from the carrying surface 401A of the bottom plate 401. The projection 402 has a main body 403 which is a projection main body, and a regulator 404 which is formed in the main body 403 and which regulates the components W. According to the present fourth embodiment, a plurality of (four in FIG. 17) projections 402 are provided, and each projection 402 has one regulator 404. The plurality of projections 402 are spaced out from one another along the components W carried on the carrying surface 401A.

The main body 403 is formed into a hollow tapering shape. The regulator 404 is formed to extend in a direction perpendicular to the carrying surface 401A of the bottom plate 401. That is, the regulator 404 is formed to extend in an arrow Z direction intersecting at right angles with an arrow X direction and an arrow Y direction which extend along the carrying surface 401A and which intersect at right angles with each other. The regulator 404 contacts side surfaces Wb of the components W carried on the carrying surface 401A to regulate the components W carried on the carrying surface. According to the present fourth embodiment, the regulator 404 is formed to extend from a base end (lower end) to a tip end (upper end) of the main body 403 integrally with the main body 403.

According to the present fourth embodiment, the regulator 404 has a regulating surface 404A, and the regulating surface 404A is perpendicular to the carrying surface 401A. The regulating surface 404A of the regulator 404 comes into surface contact with the side surfaces Wb of the components W.

The components W are formed into a columnar shape (specifically, a square columnar shape). The regulator 404 is positioned on the main body 403 and shaped so that the regulating surface 404A comes into surface contact with the outside surfaces Wb of the components W. In other words, the regulating surface 404A of the regulator 404 is formed into a shape along the outside surfaces Wb of the components W. That is, as shown in FIG. 19, the regulating surface 404A of each regulator 404 is formed into a shape along an imaginary rectangular prism surface C4 so that the regulating surface 404A comes into surface contact with the imaginary prism surface C4 along the outside surfaces Wb of a plurality of stacked components W.

Thus, a plurality of components W stacked on the carrying surface 401A are regulated by contacting the regulator 404, and are precisely positioned at the same position in the arrow X direction and the arrow Y direction. In particular, a plurality of components W stacked on the carrying surface 401A are regulated by surface contact with the regulating surface 404A, and are therefore precisely positioned.

A through-hole H41 is formed in the bottom plate 401 at a position corresponding to a hollow part (cavity part) R4 of the main body 403 so that a projection of an additional component carrying tray comes into the through-hole H41.

Figure 20:
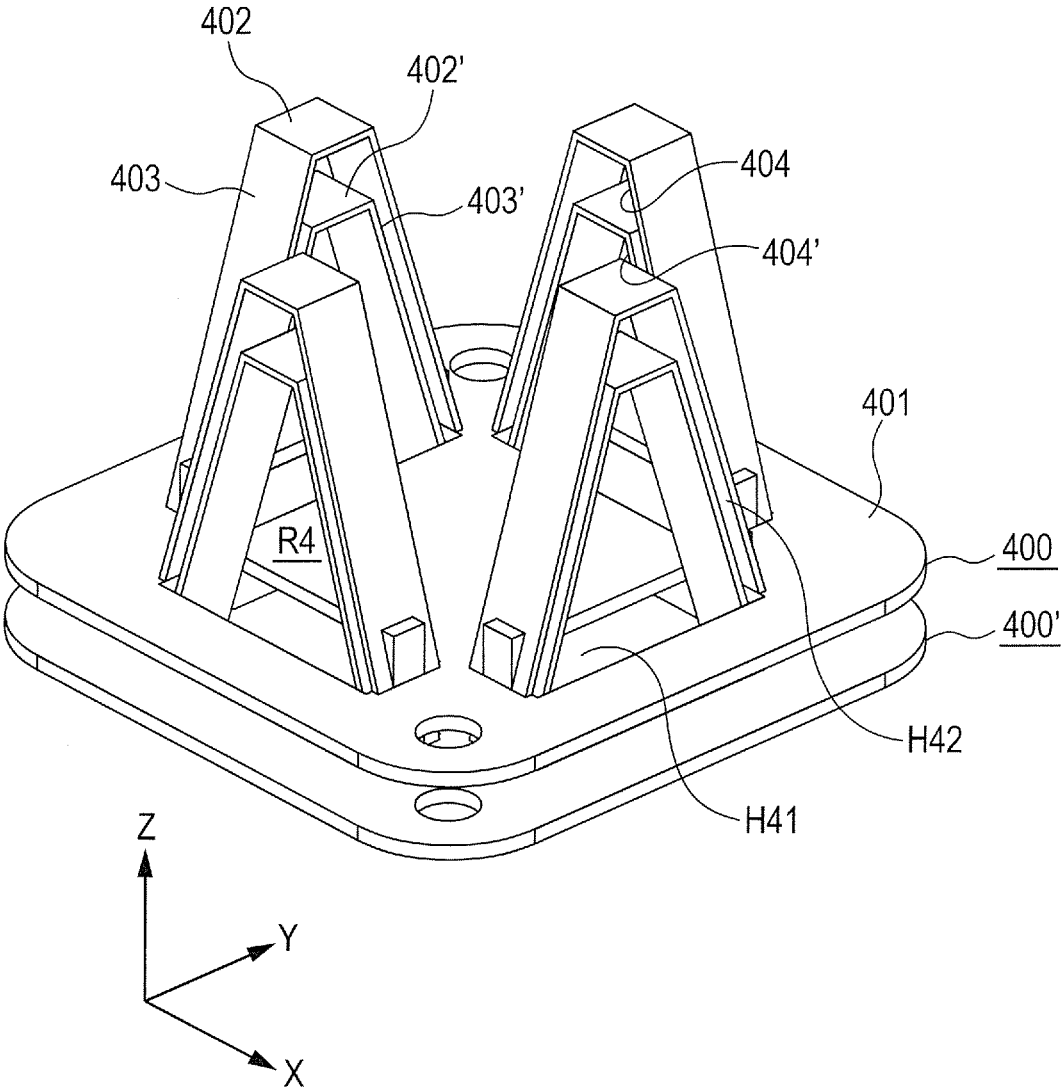
FIG. 20 is a perspective view showing how a plurality of component carrying trays in FIG. 17 is stacked.

As shown in FIG. 20, when the component carrying tray 400 is stacked on an additional component carrying tray 400' carrying no components which has the same shape as the component carrying tray 400, a projection 402' of the additional component carrying tray 400' comes into the hollow part R4 of the main body 403 through the through-hole H41. That is, since the outer shapes of the main bodies 403 and 403' are tapering shapes, the tip end of the projection 402' comes into the hollow part R4 of the main body 403 without interfering with the bottom plate 401.

Here, the tapering shape includes such shapes that the outer shape of the main body 403 is narrower at the tip end than at the base end, for example, a shape that the outer shape of the main body 403 continuously tapers as shown in FIG. 17, and a shape that the outer shape of the main body 403 tapers in stages. The part of the hollow part (cavity part) R4 of the main body 403 which comes into contact with the through-hole H41 has only to be a cavity having a size equal to or more than the tip end of the main body 403.

An opening H42 is formed in each projection 402 so that when the component carrying tray 400 is carried on the additional component carrying tray 400', the interference with a regulator 404' of the additional component carrying tray 400' is avoided. This opening H42 is formed in the regulator 404. The opening H42 formed in the projection 402 is continuous with the through-hole H41 formed in the bottom plate 401.

Thus, since the opening H42 is formed in the projection 402, the projection 402' of the additional component carrying tray 400' smoothly comes into the hollow part (cavity part) R4 of the projection 402, and a plurality of component carrying trays 400 can be densely stacked. Therefore, when a plurality of component carrying trays 400 carrying no components are conveyed, the component carrying trays 400 are piled up so that the conveyance efficiency can be increased. Although two component carrying trays 400 are provided in the case shown in FIG. 20, three or more component carrying trays 400 can be carried in a similar manner.

According to the present fourth embodiment, as shown in FIG. 17, the main body 403 has a pair of side-wall plates 411 and 412 which are arranged to face each other and which are slanted relative to the carrying surface 401A of the bottom plate 401 so as to taper toward the tip end. The main body 403 also has a top plate 413 which connects the tip ends of the pair of side-wall plates 411 and 412. The surface opposite to the regulator 404 is also open. That is, the part of the main body 403 perpendicular to the carrying surface 401A is open.

The regulators 404 are formed at the edges (side ends) of the side-wall plates 411 and 412 so that the opening H42 is formed between the pair of side-wall plates 411 and 412.

According to the present fourth embodiment, the regulator 404 is formed integrally with the edges of the side-wall plates 411 and 412 and the end of the top plate 413, and is thus substantially U-shaped when seen from the front. The substantially U-shaped regulator 404 is formed at a slant so as to expand from the tip ends (upper ends) of the side-wall plates 411 and 412 toward the base ends (lower ends), in other words, so as to taper from the base ends toward the tip ends with a width substantially equal to the thickness of the side-wall plates 411 and 412.

That is, the regulating surface 404A of the regulator 404 is formed so that the phase is shifted from the tip end toward the base end in the circumferential direction. While the position of the regulating surface 404A to contact the components W varies in the arrow Z direction, the regulating surface 404A comes into surface contact with outside surfaces Wb of the components W at any position. Part of the regulator 404 is formed in the top plate 413. However, when the regulator is omitted in the top plate 413, the regulator is formed in each of the side-wall plates 411 and 412.

Since the pair of side-wall plates 411 and 412 are arranged at a slant according to the present fourth embodiment, the projection 402' of the additional component carrying tray 400' easily comes into the hollow part R4 of the main body 403, and the opening H42 can be increased in size from the base ends toward the tip ends. Therefore, a plurality of component carrying trays 400 can be more densely stacked.

Since the regulator 404 is formed at the edges (side ends) of the side-wall plates 411 and 412, the components W can be positioned from the base ends toward the tip ends, and more components W can be carried.

Protrusions (steps) 421 are formed in the outer surfaces of the side-wall plates 411 and 412 to prevent the trays from fitting into each other when the additional component carrying trays are stacked, that is, to support the bottom plate of the additional component carrying tray when this additional component carrying tray is carried.

Although the protrusions 421 are formed in both the side-wall plates 411 and 412 according to the present fourth embodiment, the protrusion 421 has only to be formed at least one of the side-wall plates 411 and 412, and the protrusion 421 may be only formed in the side-wall plate 411 or the side-wall plate 412.

A positioning hole 423 to engage with a protrusion of a mounting stand is formed in the bottom plate 401. While this positioning hole 423 may be either a recessed hole or a through-hole, this positioning hole 423 is a through-hole according to the present fourth embodiment. The positioning hole 423 may be a hole of any shape including a round hole and a square hole as long as the bottom plate 401, that is, the component carrying tray 400 can be positioned. According to the present fourth embodiment, the positioning hole 423 is a round hole. Since the positioning hole 423 is a round hole according to the present fourth embodiment, a plurality of positioning holes 423 are preferably provided. The precision of the positioning of the component carrying tray 400 relative to the mounting stand is further improved not only by the shape of the hole 423 but also by the provision of a plurality of positioning holes 423.

As described above, the components carried on the component carrying tray are not limited to cylindrical components. If the regulator 404 of the component carrying tray 400 is provided in accordance with the outside surfaces Wb of the components W, advantageous effects similar to those according to the first embodiment described above can be obtained for components other than the cylindrical components.

The present invention is not limited to the embodiments described above, various modifications can be made by a person having ordinary skill in the art within the technical idea of the present invention.

Although the main body is disposed so that the upper regulator and the lower regulator regulate the inside surfaces of the cylindrical components according to the second embodiment described above, the main body may be disposed so that the upper regulator and the lower regulator regulate the outside surfaces of the components.

In the first to fourth embodiments described above, the regulator has the regulating surface, and the regulating surface comes into surface contact with side surfaces of the components. However, this is not a limitation. The regulating surface may be configured to come into line contact with the side surfaces of the components.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-066174, filed Mar. 27, 2013, which is hereby incorporated by reference herein in its entirety.

What is claimed is:

1. A component carrying tray comprising:

a bottom plate having a planar carrying surface capable of having a plurality of components stacked thereon;

a plurality of projections formed to project from the planar carrying surface, each projection of the plurality of projections including:

a main body, the main body being hollow and having a tapering shape defined by a pair of side-wall plates;

a regulator, the regulator being formed on at least one end of the pair of side-wall plates and having a regulating surface perpendicular to the planar carrying surface, the regulating surface configured to regulate each of the plurality of components stacked on the planar carrying surface by contacting an inside surface of each of the plurality of components stacked on the planar carrying surface; and an opening formed between the pair of side-wall plates and configured to avoid, when the component carrying tray is stacked on an identical additional component carrying tray, interference between one of the plurality of projections of the component carrying tray and a regulator of the identical additional component carrying tray;

a through-hole in the bottom plate at a position corresponding to the hollow portion of the main body configured to allow, when the component carrying tray is stacked on the identical additional component carrying tray, a projection of the identical additional component carrying tray to enter the hollow portion of the main body; and a handle, the handle being disposed at a location surrounded by the plurality of projections and being formed to project from the bottom plate in the same direction as the plurality of projections, wherein, when the component carrying tray is stacked on the identical additional component carrying tray, the opening of the component carrying tray is co-planar with the regulator of the identical additional component carrying tray, and wherein the plurality of projections are spaced out from one another.

2. The component carrying tray according to claim 1, wherein a protrusion is formed on at least one of the pair of side-wall plates to support a bottom plate of the identical additional component carrying tray when the identical additional component carrying tray is stacked on the component carrying tray.

3. The component carrying tray according to claim 1, wherein the regulating surface is formed at a position to contact an inside surface of at least one component of the plurality of components when the at least one component has a cylindrical shape.

4. The component carrying tray according to claim 1, further comprising a positioning hole formed in the bottom plate to engage with a positioning pin of a mounting stand.

5. A component carrying tray set comprising:

the component carrying tray according to claim 1; and an annular component, the annular component being (1) at least one of the plurality of components, and (2) positioned with contact between an inside surface of the annular component and the regulating surface of the component carrying tray.

6. A tray in which the component carrying tray according to claim 1 is contained in a pocket.

7. A tray according to claim 6, wherein the pocket has a depth greater than the height of the component carrying tray.

8. A component carrying tray comprising:

a bottom plate having a planar carrying surface capable of having a plurality of components stacked thereon;

a plurality of projections formed to project from the planar carrying surface, each of projection of the plurality of projections including:

a main body, the main body being hollow and having a tapering shape defined by a pair of side-wall plates, and having an interior side and an exterior side, wherein each of the side-wall plates extends from the interior side to the exterior side;

a regulator, the regulator being formed on at least one end of the pair of side-wall plates that is on the exterior side of the main body, and having a regulating surface perpendicular to the planar carrying surface, the regulating surface configured to regulate each of the plurality of components stacked on the planar carrying surface by contacting an inside surface of each of the plurality of components stacked on the planar carrying surface; and an opening formed between the pair of side-wall plates, extending upward from the bottom plate and opening to the exterior side of the main body;

a through-hole in the bottom plate at a position corresponding to the hollow portion of the main body; and a handle, the handle being disposed at a location surrounded by the plurality of projections and being formed to project from the bottom plate in the same direction as the plurality of projections, wherein the plurality of projections are spaced out from one another.

9. The component carrying tray according to claim 8, further comprising a plurality of projections, wherein each projection has a main body with an interior side, wherein each interior side faces the interior side of another projection.

10. A component carrying tray comprising:

a bottom plate having a planar carrying surface capable of having a plurality of components stacked thereon;

a plurality of projections formed to project from the planar carrying surface, each projection of the plurality of projections including:

a main body, the main body being hollow and having a tapering shape defined by a pair of side-wall plates;

a regulator, the regulator being formed on at least one end of the pair of side-wall plates and having a regulating surface having two side edges, the side edges being disposed on a plane perpendicular to the planar carrying surface; and an opening formed between the pair of side-wall plates and defined by the two side edges of the regulating surface, the opening being in the plane;

a through-hole in the bottom plate at a position corresponding to the hollow portion of the main body; and a handle, the handle being disposed at a location surrounded by the plurality of projections and being formed to project from the bottom plate in the same directions as the plurality of projections, wherein the plurality of projections are spaced out from one another.

* * * * *